US007905033B1

(12) United States Patent
Perenich

(10) Patent No.: US 7,905,033 B1
(45) Date of Patent: Mar. 15, 2011

(54) ENERGY-RETURN SHOE SYSTEM

(76) Inventor: Stephen Perenich, Bettendorf, IA (US)

( * ) Notice: Subject to any disclaimer, the term of this patent is extended or adjusted under 35 U.S.C. 154(b) by 794 days.

(21) Appl. No.: 11/833,917

(22) Filed: Aug. 3, 2007

Related U.S. Application Data

(63) Continuation-in-part of application No. 10/826,693, filed on Apr. 19, 2004, now Pat. No. 7,290,354, and a continuation-in-part of application No. 10/717,915, filed on Nov. 21, 2003, now abandoned.

(60) Provisional application No. 60/427,959, filed on Nov. 21, 2002, provisional application No. 60/491,260, filed on Jul. 31, 2003.

(51) Int. Cl.
*A43B 13/28* (2006.01)
*A43B 13/14* (2006.01)
*A43B 1/10* (2006.01)
*A43B 5/00* (2006.01)

(52) U.S. Cl. ..... 36/27; 36/114; 36/102; 36/31

(58) Field of Classification Search ..... 36/27, 114, 36/102–103, 31, 28, 58.6, 92, 105, 58.5, 36/69, 80, 72 B, 73, 132, 136; 482/77, 76, 482/75; 601/29, 34, 33, 28, 27
See application file for complete search history.

(56) References Cited

U.S. PATENT DOCUMENTS 1,613,538 A 1/1927 Schad
1,964,406 A 6/1934 Pellkofer
2,408,617 A * 10/1946 Ferrar ..... 36/7.8
2,522,515 A * 9/1950 Hill ..... 36/104
2,953,861 A 9/1960 Horten
3,205,596 A 9/1965 Hoffmeister
3,219,358 A 11/1965 Hagner
3,557,782 A 1/1971 Wafer
4,196,903 A 4/1980 Illustrato
4,296,557 A * 10/1981 Pajevic ..... 36/7.8
4,302,891 A 12/1981 Gulli
4,457,084 A 7/1984 Horibata et al.
4,492,374 A 1/1985 Lekhtman et al.
4,912,859 A 4/1990 Ritts
4,936,030 A 6/1990 Rennex
4,944,099 A 7/1990 Davis
5,282,325 A 2/1994 Beyl
5,464,380 A 11/1995 Ikeda et al.
5,621,984 A 4/1997 Hsieh
5,701,685 A 12/1997 Pezza
(Continued)

*Primary Examiner* — Jila M Mohandesi
(74) *Attorney, Agent, or Firm* — Larson & Larson, P.A.; Frank Liebenow; Justin Miller

(57) ABSTRACT

An energy-return shoe system includes a shoe portion for containing a foot, with an upper sole on a bottom surface of the shoe part. The upper sole has an upper toe sole area and an upper heel sole area. The upper sole is capable of bending at a point between the upper toe sole area and the upper heel sole area. A lower sole has a lower toe sole area and a lower heel sole area, also capable of bending at a point between the lower toe sole area and the lower heel sole area. A compressible heel mechanism interfaces the upper heel sole area to the lower heel sole area so that the upper heel sole area is held parallel to the lower heel sole area and the upper heel sole area is held in a same horizontal position with respect to the lower heel sole area. A spring pushes the upper heel sole area away from the lower heel sole area, thereby absorbing energy upon impact and releasing the energy on step-off.

8 Claims, 37 Drawing Sheets

U.S. PATENT DOCUMENTS

| | | | |
|---|---|---|---|
| 5,896,679 | A | 4/1999 | Baldwin |
| 5,916,071 | A | 6/1999 | Lee |
| 5,926,975 | A | 7/1999 | Goodman |
| 6,115,942 | A | 9/2000 | Paradis |
| 6,189,239 | B1 | 2/2001 | Gasparovic et al. |
| 6,684,531 | B2 | 2/2004 | Rennex |
| 2004/0040180 | A1 | 3/2004 | Rennex et al. |
| 2005/0262725 | A1 | 12/2005 | Rennex et al. |

* cited by examiner

ENERGY-RETURN SHOE SYSTEM

CROSS-REFERENCE TO RELATED APPLICATIONS

This application is a continuation of non-provisional application Ser. No. 10/826,693 filed Apr. 19, 2004 which is a continuation of non-provisional application Ser. No. 10/717,915 filed Nov. 21, 2002 which is a continuation of prior U.S. provisional application No. 60/427,959, filed Nov. 21, 2002, and 60/491,260, filed Jul. 31, 2003. The entire contents of all the above applications are hereby incorporated by reference.

TECHNICAL FIELD OF THE INVENTION

The present invention relates to the general art of boots and shoes, and to the particular field of impact absorbing and energy-return mechanisms associated with boots and shoes.

BACKGROUND OF THE INVENTION

It has long been known, that when people walk, jog, or run, a significant percentage of their forward and upward kinetic energy is wasted and lost. This loss results in two undesirable effects, the first of which is locomotion inefficiency. More specifically, a person's potential for attaining their maximum walking/running speed and endurance as well as jumping height (without motorized assistance) is diminished. The second negative effect of this lost energy is manifested in the substantial shock which is imparted to a person's knees and feet when impacting with the ground while running or jumping. As a result, great effort has been exerted by both independent inventors and large corporations to develop effective "energy-return" footwear that could replace standard athletic footwear.

Energy-return footwear designs, generically referred to as "spring-shoes", have been around for centuries and may be as old as the invention of springs themselves. The concept is obvious: build shoes with springs or some other energy storage device and augment a person's performance and/or comfort. However, this has been a difficult task as evidenced by the hundreds of such patents, filed since the mid 1800s, with very few designs being accepted in the marketplace.

Designing an effective energy-return shoe requires identifying and meeting several important objectives. The shoe must: 1) store and return a significant portion of kinetic energy, 2) be stable and controllable, 3) promote a natural motion during locomotion, 4) be both durable and reasonably light, 5) be simple in design, and 6) be designed with spring geometry that can be optimized for either comfort or performance or any compromise in between. Creating a shoe that successfully combines these qualities would represent a revolutionary advancement in the art and insure its widespread acceptance by consumers.

In order to store and return a significant portion of energy during locomotion (i.e. the first objective), a shoe's sole must transfer kinetic energy due to heel compression forces, and return them to the toe, during liftoff. That is, the heel and toe portions of the soles must work together upon heel-strike and toe-lift, allowing greater energy storage and return. Additionally, the sole must be both substantially compressible and free to compress and expand without hindrance (i.e. not be dampened by the walls of a rubber sole or any other impediments). Furthermore, the spring rates should be tailored to the user's weight and specific use such that the springs store and return as much of the impact forces as possible. These qualities work together to insure that during toe-off the wearer will experience the right force at the right time for a reasonable duration. Energy-return can be even further augmented if a shoe's sole can be held in the compressed position through the point of peak load and released during toe lift-off. Such an arrangement would allow for spring rates 2 to 3 times higher than would otherwise be used.

The second objective of an effective energy-return footwear design is that it be both stable and controllable. This aspect is important both for allowing a user to effectively use the energy that is returned and for obvious safety reasons. Shoes with compressible soles that have been designed with an emphasis on energy-return have struggled in meeting this objective. This is often due to the fact that the lower sole is not constrained in its movement relative to the upper sole and there is no provision for the use of a wearer's toes (or a structure that performs in a similar function) or in the case of higher compression designs there is a lack of ankle support. More specifically, the lower sole may slide or skew longitudinally or laterally, or sometimes in any direction, relative to the wearer's foot and the design may employ a rigid upper and lower sole that does not bend at the ball of the foot limiting the user's balance and traction that toes can provide. In many cases, where sole designs have sought to address these limitations, they have relied on the use polymers instead of, or in addition to, mechanical devices or they have limited the use of mechanical devices to the heel region. In so doing, these designs have compromised energy-return.

The third objective of an effective energy-return shoe is that the sole design promotes a natural motion during locomotion. This is important because energy-return footwear that encourages unnatural motions by the wearer compromises the benefits of storing and returning energy in locomotion and may also pose a safety risk. To provide for natural movement, the shoe sole design must: provide for the effective use of the wearer's toes (i.e., upper and lower toe sole pivoting from an upper and lower heel sole), release the stored-energy in a direction that is perpendicular to the user's foot (i.e. generally in line with the wearer's leg), provide a rigid lower sole frame with a flexible tread surround that is likened to a bare foot (or in the case of a higher-compression design, a laterally tilting lower sole with longitudinally pivoting heel and toe pads) and release the stored energy at an optimal time during the stride. Other energy-return footwear designs that have inadequately addressed these requirements have failed to promote a natural running motion and would not be considered a viable alternative to standard athletic footwear.

The fourth objective of an effective energy-return footwear design is that it be both durable and reasonably light. This goal represents a significant challenge for full-length mechanical soles due to the extreme forces at play and fact that they usually rely on metal components that are either reasonably light or durable but not both. Although major advancements have been made in the area of materials engineering (i.e. composite fibers) these developments alone cannot solve this problem. The solution, instead, is found in designing an efficient mechanical system that employs structure-leverage and the efficient use of materials. For example it is preferred that a large percentage of the sole's height or thickness be compressible (i.e. that it is not unnecessarily tall.)

The fifth characteristic of an effective energy-return shoe is that it be simple in design. This is as important for energy-return footwear designs as it is for most any mechanical design. Benefits to design simplicity include reduced friction, improved durability and minimized manufacturing cost.

The sixth objective of an effective energy-return shoe is that it be designed such that the spring geometry can be optimized for either comfort or performance or any compromise in between. There exist many energy-return footwear patents that recognize the benefit of tailoring the energy-storage component's capacity to a user's weight and/or type of activity, but the vast majority of these designs do not address the merits of managing the force rates by which energy is stored and returned. The underlying premise of this concept is that there is a tradeoff between energy-absorption and energy-return. That is, a shoe that is designed for comfort would not be ideally suited for performance applications and vice-versa. More specifically, the energy-return forces for a comfort-designed shoe should be linear and progressive (for example as delivered by a simple compression spring as widely exemplified in the prior art). On the other hand, energy-return forces for a performance shoe should be either constant or regressive. For example, employing a regressive force rate would mean that as the shoe compresses, the resistance force diminishes and conversely, as the shoe expands, the expansion force increases. Additionally, the force curve could be developed as a wide range of compromises between pure comfort and pure performance. Such variety of force rate characteristics are achieved by using compression springs, torsion springs or extension springs between two opposing hinges or a spring combination thereof. The method and structure for creating force rate curves optimized for a variety of applications and preferences will be explained in the Detailed Description of the Invention section.

These six objectives represent therefore the ideal characteristics that have eluded spring-shoe designers for years. Certain designs may have excelled in one or two or three of these areas but none has combined all objectives in a single package. The following examples are provided to illustrate the limitations of these prior designs.

A patent of interest is U.S. Pat. No. 4,133,086 "Pneumatic Springing Shoe" to Brennan which discloses a rigid lower sole supporting an upper sole via two pneumatic springs. This design is limited by lack heel-to-toe energy transfer and an inflexible lower sole which prevents a natural running motion. Also this design is unnecessarily heavy and bulky due to the fact that it requires a tall sole to produce the desired amount of compression.

U.S. Pat. No. 4,196,903 "Jog-Springs" to Illustrato employs a full-length spring-suspended sole but does not provide a correlation between the heel springs and the toe springs to effectively transfer energy from heel to toe. Additionally, it is limited by its inherent instability and uncontrollability and unnatural use.

U.S. Pat. No. 4,912,859 "Spring-shoe" to Ritts discloses a full-length mechanical sole that relies on a hefty longitudinal link to resist lateral tilting. This design is limited by a lack of heel-to-toe energy transfer and inflexible lower sole which prevents a natural running motion. Also this design relies on the stoutness of this link to limit such movement and thus adds considerable weight to the sole.

Another patent of interest is U.S. Pat. No. 4,936,030 to Rennex titled, "Energy Efficient Running Shoe." This patent recognizes that an increase in performance requires transfer of energy from heel-strike to the ball or toe region during step-off via a series of complex levers and shafts. This patent recognizes that an increase in performance may be possible with a system to hold the energy loaded during heel-strike and release it from the ball or toe region during step-off. This design employs a ratchet to hold the loaded spring and triggers its release by bending the toe section of the shoe. These structures provide neither an optimum nor precise timing for energy release. The optimum timing of energy release is immediately following ball peak-force during step-off. The system releases the loaded spring either: 1) when said spring reaches a certain and fixed degree of compression, 2) when said spring reaches the limit of compression during push-off, or 3) after a fixed time delay. Although the patent neither explains nor diagrams the process by which it accomplishes (2) or (3), these methods are inadequate and not optimal. The first and third processes are based on fixed criteria and cannot adapt to the variable forces and time periods during normal running. The second process is inadequate because it releases the spring prematurely. A user, during a turn or stop may load the forces on his forefoot at constant level before he has picked his final direction. This process therefore, can cause the user to lose control. The system does not guarantee nor does it disclose that the ball and heel will compress in a parallel manner. Additionally, these complex structures fall short in the area of promoting natural movement; provide a platform for stability, durability and lightness.

U.S. Pat. No. 5,343,637 "Shoe and Elastic Sole Insert Therefore" to Schindler discloses two elastic inserts contained within a hollow and flexible rubber sole. Although this design does allow flexibility at the ball of the foot, the lack of a framework for the lower sole results in an uncontrolled compression and expansion of the spring. This limits the user's ability to balance and move in a controlled fashion. To the extent that stiffer sole walls are used to improve stability, there is a commensurate increase in damping which diminishes the energy-return capacity of the spring.

Another patent of interest is U.S. Pat. No. 5,343,639 "Shoe with an Improved Midsole" to Kilgore et al., employs a "plurality of compliant elastomeric support elements" in the heel to absorb impact forces. Although this design attempts to make advances in the resilient material employed, it is still limited in the same way that all polymer-based designs are limited. More specifically, this design is compromised by the fact that there is no provision for the transfer of heel impact forces to the toe during lift-off, the sole is not substantially compressible and there is no provision for optimizing the energy-return force curves for performance applications.

In another patent of interest, U.S. Pat. No. 5,435,079 "Spring Athletic Shoe" to Gallegos discloses a conical heel spring. This design is limited by the lack of energy transfer from the heel to the toe. Additionally this design is limited in that the spring geometry cannot be tailored to anything other than comfort (i.e. not for performance applications).

U.S. Pat. No. 5,517,769, "Spring-Loaded Snap-Type Shoe," to Zhao. This patent recognizes that a significant increase in performance may be possible with a system to hold the energy loaded during heel-strike and release the energy during step-off. The disclosed system used a ratchet to hold the loaded spring and triggers its release by bending the toe section of the shoe. Thus, this system attempts to time the release of energy during step-off. This system provides neither an optimum nor precise timing for energy release. The optimum timing of energy release occurs immediately following the decrease force during step-off. The system releases the loaded spring when the user bends at the ball of the foot which is not necessarily during and perhaps never at the optimum time. The system also returns energy to the heel alone. This is not ideal because the heel is not in contact with the ground during step-off. The system also requires a hollow cavity extending the length of the foot for the containment of the ratchet and spring system but does not provide a suspension system for maintaining this cavity leaving it to compress randomly.

Another patent of interest is U.S. Pat. No. 6,029,374 to Herr: "Shoe and Foot Prosthesis with Bending Beam Spring Structures." This patent attempts to address the problem with carbon fiber bending beam springs. This patent also attempts to address the need for both heel and toe springs that prevent lateral movement. This structure is inadequate for some of the following reasons: 1) It does not provide a strictly parallel postured upper and lower sole and thus it cannot return more than half the user's weight, 2) it does not provide a parallel upper and lower toe sole and therefore depends on a tapered leaf spring for traction and control in which it does not provide either in an optimum way, 3) it does not provide a hold and release system (HRS) that limits the combined load forces of the springs to approximately the user's weight.

Another patent of interest is U.S. Pat. No. 6,282,814 B1 "Spring Cushioned Shoe" to Krafsur, et al., wherein wave springs are placed in the heel and toe regions of a polymer sole. Although this sole design does include mechanical components (i.e. wave springs) in both the toe and heel regions of the sole, their effectiveness is greatly diminished by their independence and disconnection which prevents a transfer of energy from the heel to the toe. Also, they are limited by the dampening effect of the polymer sole in which they are placed. Additionally, wave springs themselves tend to lack free movement due to the friction generated by their "crest to crest" design.

Another patent of interest is U.S. Pat. No. 6,684,531 to Rennex for a "Spring Space Shoe," which is hereby incorporated by reference. This patent introduces a spring-lever mechanism that provides some level of energy absorption upon impact and energy-return during step-off and discloses a series of linkages that prevent longitudinal tilting between the top and bottom soles. This design, however, is limited in its stability and controllability because it lacks a means to prevent front-to-back sliding of the user's foot with respect to the lower sole of the shoe. For example, in the mechanism of FIG. 1*a*, there is nothing to prevent the right side (heel of foot) of the mechanism from moving forward with respect to the left side (ball of foot). Additionally, the structures disclosed are not designed to prevent any substantial lateral forces from causing the upper sole to slide sideways relative to the lower sole. Another limitation in this design is that it does not include a toe sole structure, thereby eliminating the balance and control and traction that toes provide to a person. Furthermore, the disclosed "heel hugger" structure does not provide for an energy-return vector, perpendicular to the user's foot. This means that the energy is not released in a direction that is in-line with the force of the user's leg. Additionally it does not either provide a flexible tread/sole around the perimeter of the lower sole nor does it disclose a longitudinally non-tilting yet laterally pivoting lower sole with longitudinally pivoting heel and toe pads, so a user's lateral movement is constrained and becomes awkward. Finally, although it does suggest that a combination of different springs may be used to manage spring forces, it does not disclose how a torsion spring could be included for this purpose and how it could be used to effectively include it in the structure.

Another patent of interest is U.S. Pat. No. 6,719,671 B1 "Device for Helping a Person to Walk" to Bock. This patent discloses a large leaf spring that extends from the back of the knee to the shoe sole as a means of storing and releasing energy during locomotion. Although this design affords a large degree of sole compression, it also weighs more than 5 times the amount of other energy-return footwear. This is due, in large part, to the design and therefore size of the leaf spring. Additionally, this patent does not provide a strictly parallel postured upper and lower sole of normal length nor does it provide a parallel upper and lower toe sole and therefore does not provide adequate balance and control. Furthermore, it does not provide a longitudinally pivoting lower sole and therefore does not allow for adequate traction agility and control.

Finally, U.S. Patent Application 2004/0177531 titled, "Intelligent Footwear System," discloses a spring heel that adjusts tension in response to impact forces to modify performance characteristics. Although, this design accounts for the stiffness requirement of a spring depending on the activity it is limited in a number of respects. First there is no transfer of energy from the heel to the toe. Additionally the spring geometry can not be altered and so the shoe is only optimized for comfort and would not be very effective in performance applications. Also, like other shoes that have a polymer component, this design is compromised in its ability to freely store and return energy.

Spring-shoes thus have not been entirely satisfactory in that they have not permitted users to concurrently experience substantial energy-return, traction, control, safety and agility, and therefore have been viewed as incomparable and inferior to non-spring-loaded footwear. Furthermore, we are no closer to reaching the dream of augmenting performance, as no non-fuel-propelled footwear device has so far allowed users to increase their maximum running speed. (While some have allowed an increase in stride-length, their unnatural use and/or excessive weight prevent users from running any faster than with standard running shoes.) Additionally, these prior efforts have employed either complex, expensive, unreliable structures and/-or ineffective and imprecise structures. What is needed is a shoe system that achieves the aforementioned six objectives.

SUMMARY OF THE INVENTION

In one embodiment, an energy-return shoe system is disclosed including an upper sole affixed to a shoe portion (for holding the wearer's foot) and a lower sole. An upper toe support plate is pivotally connected to an upper heel support plate and both are affixed to the upper sole. A lower toe support plate is affixed to a top surface of the lower sole and interfaced to the upper toe support plate with at least one toe suspension mechanism. A lower heel support plate is affixed to the top surface of the lower sole and interfaced to the upper heel support plate by at least one heel suspension mechanism while the lower toe support plate is also pivotally connected to the lower heel support plate. The toe suspension mechanisms includes a top toe plate affixed to the upper toe support plate and a bottom toe plate affixed to the lower toe support plate with one or more toe hinges arranged to close in the same direction. Each of the toe hinges has a first arm connected to a second arm by a toe hinge pivot. A distal end of the first arm is pivotally connected to the top toe plate and a distal end of the second arm is pivotally connected to the bottom toe plate. A rigid coupling pivotally connects the toe hinge pivots, holding the top toe plate and the bottom toe plate in a parallel relationship. The heel suspension mechanism has a top heel plate affixed to the upper heel support plate and a bottom heel plate affixed to the lower heel support plate. There is a plurality of heel hinges, at least two of which are arranged to close in a first direction and at least one of which is arranged to close in an opposite direction. Each of the heel hinges has a first heel arm connected to a second heel arm by a heel pivot. A distal end of the first heel arm is pivotally connected to the top heel plate and a distal end of the second heel arm is pivotally connected to the bottom heel plate. A first rigid coupling tube pivotally connects the heel pivots of the heel hinges arranged to close in the first direction and a second rigid coupling tube slidably interfaced with the first rigid coupling tube pivotally connects to the heel pivots of the heel hinge arranged to close in the opposite direction. This assures that the heel pivots of the heel hinges arranged to close in the first direction and the heel pivots of the heel hinge arranged to close in the opposite direction are aligned and held equidistant between the top heel plate and bottom heel plate and that the top heel plate is held in horizontal synchronization with the bottom heel plate. At least one spring pushes the upper heel support plate away from the lower heel support plate.

In another embodiment, an energy-return shoe system is disclosed including a shoe portion for containing a user's foot with an upper sole affixed to a bottom surface of the shoe portion that has an upper toe sole area and an upper heel sole area. The upper sole is capable of bending at a point between the upper toe sole area and the upper heel sole area. A lower sole has a lower toe sole area and a lower heel sole area, also capable of bending at a point between the lower toe sole area and the lower heel sole area. A compressible mechanism interfaces the upper heel sole area to the lower heel sole area so that the upper heel sole area is held parallel to the lower heel sole area and the upper heel sole area is held in a same horizontal position with respect to the lower heel sole area. A device is provided for pushing the upper heel sole area away from the lower heel sole area.

In another embodiment, a suspension mechanism for absorbing and returning energy in a shoe is disclosed including a shoe portion for containing the user's foot, top heel plate and a bottom heel plate. Multiple heel hinges are provided, at least two of which are arranged to close in a first direction and at least one is arranged to close in an opposite direction. Each of the heel hinges has a first heel arm connected to a second heel arm by a heel pivot. A distal end of the first heel arm is pivotally connected to the top heel plate and a distal end of the second heel arm is pivotally connected to the bottom heel plate. A first coupling tube pivotally connects the heel pivots of the heel hinges arranged to close in the first direction and a second coupling tube slidably interfaced with the first coupling pivotally connects the heel pivots of the heel hinge arranged to close in the opposite direction such that the heel pivots of the heel hinges arranged to close in the first direction and the heel pivots of the heel hinges arranged to close in the second direction are aligned and held equidistant from the top and bottom heel plates. As such, the top heel plate is held in horizontal synchronization with the bottom heel plate.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
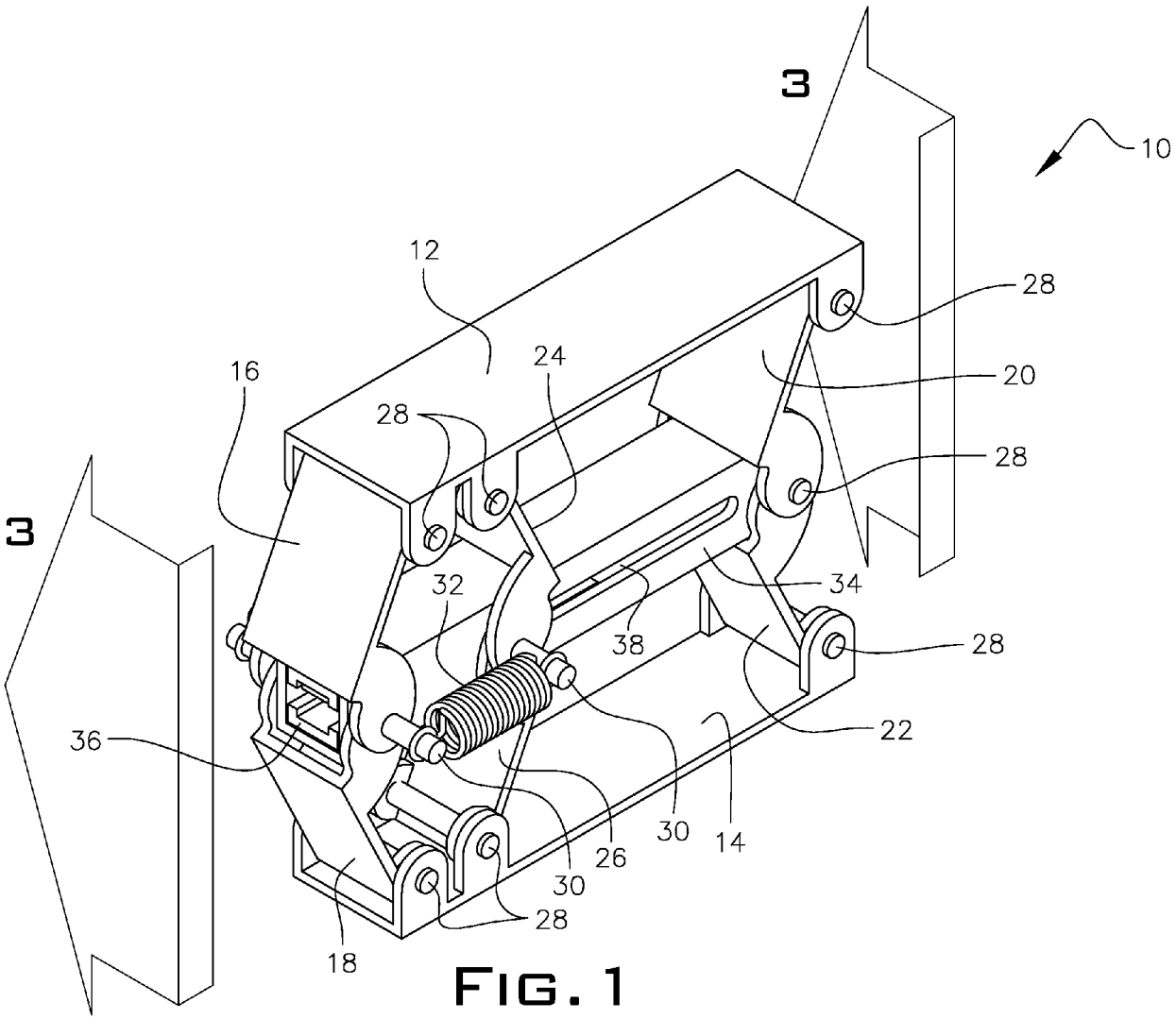
FIG. 1 illustrates an isometric view of a heel suspension mechanism of a first embodiment of the present invention.

Reference will now be made in detail to the presently preferred embodiments of the invention, examples of which are illustrated in the accompanying drawings. Throughout the following detailed description, the same reference numerals refer to the same elements in all figures. For the purpose of this specification, the term "shoe" is used generically, meaning any type of footwear including, but not limited to, shoes, boots, snowshoes, ski boots, ice skates and roller skates. Throughout this description, the term "horizontal synchronization" refers to keeping two surfaces or plates in the same horizontal position relative to each other while allowing the two surfaces or plates to move vertically with respect to each other, each set of points moving together or apart the same amount of distance. For example, if two plates are planar and parallel, one can find a perpendicular line between the two plates at a location (x, y) one plate, (x', y') on the second plate and a length of z. One can find a second perpendicular line between the two plates at a location (a, b) one plate, (a', b') on the second plate and a length of c. As the plates move closer to each other or farther apart, there is no substantial change in the (x, y), (x', y'), (a, b) and (a', b') position, only the length z and c change and they both change by the same distance. So if z and c are equal at one position, they are equal at all positions. If one is 1.2" and the other is 1.4" inches and the plates move closer by 0.5", then the first one is 0.7" and the second one is 0.9". There is no restriction that the plates are flat, nor do they have to be parallel, though this relationship is preferred in many embodiments. For example, one of the two plates may have a curvature or the two plates may be planar and have a slight angle with respect to each other and still remain in horizontal synchronization.

Throughout this description, the term "parallel synchronization" refers to keeping two surfaces or plates in the same longitudinal relationship to each other while allowing the two surfaces or plates to move vertically with respect to each other, each set of points moving together or apart the same amount of distance. In parallel synchronization, one plate is allowed to move forward or backward with respect to the other plate. Parallel synchronization is similar to horizontal synchronization, except that in parallel synchronization, the top plate is capable of moving back with respect to the top plate whereas in horizontal synchronization, such movement is not allowed.

Referring to FIG. 1, an isometric view of a system of a heel suspension mechanism of a first embodiment of the present invention is shown. The suspension mechanisms of FIGS. 1-5 allow free vertical movement while providing front/back and lateral stability so that when integrated into a shoe as will be shown later, the upper sole of the shoe does not slide forward/backward or laterally with respect to the lower sole. Furthermore, the shoe remains parallel with the sole. Such movement constraints are desirable for the wearer, in that without such movement constraints, an unnatural feel, perhaps similar to walking on ice or on a trampoline, is experienced. Additionally, any significant forward/backward or lateral sliding may present a safety issue. To achieve this stability, the suspension mechanism 10 includes a top heel plate 12 that is affixed to an upper heel support plate (see FIG. 8) and a bottom heel plate 14 that is affixed to a lower heel support plate (see FIG. 8). The top heel plate 12 and bottom heel plate 14 are held parallel to each other and are prevented from skewing or sliding with respect to each other by three heel hinges, although separate upper and lower links as well as additional heel hinges (or half hinges or links) are envisioned if needed. By preventing them from skewing or sliding, they are aligned in the same horizontal position (horizontally synchronized). That is to say, the top heel plate 12 does not move horizontally with respect the bottom heel plate 14 while remaining parallel. The only relative direction that the top heel plate 12 is allowed to move with respect to the bottom heel plate 14 is towards and away from each other.

In this example, two of the heel hinges close in one direction while the third heel hinge closes in the opposite direction. In other embodiments, more than three hinges are provided as needed for structural strength. In other embodiments, it is envisioned to provide half hinges or separate upper or lower links.

The first heel hinge consists of two heel arms 16/18 hingedly coupled to the top heel plate 12 and bottom heel plate 14 by heel pivots 28. It should be noted that the heel pivots 28 are any hinge/pivot known in the industry including screws/bolts, shafts/retainer-rings and rivets. The heel arms 16/18 are hingedly connected to each other by another heel hinge pivot 30 that extends outwardly to accept extension springs 32. The exemplary mechanism as shown uses extension springs 32, but still functions without such extension springs 32, relying on other types of springs as will be shown later. A second and opposing heel hinge consists of two heel arms 24/26, also hingedly coupled to the top heel plate 12 and bottom heel plate 14 by pivots 28. The heel hinge arms 24/26 are hingedly connected to each other by another heel hinge pivot 30 that extends outwardly to accept the extension springs 32. A third heel hinge is configured to bend in the same direction as the first heel hinge consists of two heel arms 20/22, also hingedly coupled to the top heel plate 12 and bottom heel plate 14 by pivots 28. The hinge arms 20/22 are hingedly connected to each other by another hinge pivot 28.

The parallel relationship between the top heel plate 12 and bottom heel plate 14 is maintained by inter-hinge coupling tube performed by a rigid inner coupling tube 36 slidably located within a rigid outer coupling 34. The outer coupling tube 34 is pivotally connected to the first heel hinge (16/18) and third heel hinge (20/22), assuring that both the first heel hinge (16/18) and third heel hinge (20/22) will bend the same amount as each other. The inner coupling tube 36 is coupled to the pivot 30 of the second heel hinge 24/26, sliding within the outer coupling tube 34. It is preferred that the outer dimensions of the inner coupling tube 36 are slightly smaller than the inner dimensions of the outer coupling tube 34, allowing the inner coupling tube 36 to slide within the outer coupling tube 34 without permitting excessive skewing. The inner coupling tube 36 maintains that the second heel hinge (24/26) also bends the same amount and that the center pivots 28/30 of all heel hinges maintain the same distance (equidistant) from the top plate 12 or bottom plate 14. Hence, a plane drawn (not shown) though the center pivots 28/30, maintains a parallel relationship with the top plate 12 and bottom plate 14. The top plates 12 or bottom plates 14 of the heel hinges (16/18, 24/26, 20/22) and the heel arms (16, 18, 24, 26, 20, 22) form parallelograms to enforce the parallel relationship and planar synchronization between the top plate 12 and the bottom plate 14.

The outer coupling tube 34 has a slot 38 through which the center pivot 30 of the second heel hinge (24/26) travels as the suspension mechanism 10 is compressed and released, such that when the center pivot 30 of the second heel hinge (24/26) reaches the end of the slot 38, the suspension mechanism 10 can be compressed no more, thereby limiting the closure of the heel hinges (16/18, 24/26, 20/22).

The inner coupling tube 36 provides stops at each end, keeping the center pivots 30 of the first heel hinge 16/18 and second heel hinge 24/26 from opening beyond a desired position, maintaining a minimum compression. It can be understood that if the heel hinges (16/18, 24/26, 20/22) of the present invention were allowed to open far enough as to be perpendicular to the top heel plate 12 and bottom heel plate 14, on impact, would resist closure. Therefore, they are held in a slightly bent relationship.

It should be noted that the preferred coupling includes an inner coupling tube 36 and an outer coupling tube 34 as shown, thereby reducing friction. Other forms of coupling are possible as long as all center pivots 28/30 maintain a relatively parallel relationship to the top heel plate 12 and the bottom heel plate 14. This can be accomplished through inner/outer couplings of different shapes such as tubular or triangular, etc. Other couplings are possible including a tube or solid coupling between the hinges that collapse in a first direction (16/18, 20/22) and a slot in the coupling similar to the existing slot 38 through which the pivot pin 30 of the opposing direction hinge 24/26 passes. Although alternate couplings without an inner sliding coupling function properly in their primary goal, they tend not to disperse forces and can insert unwanted friction into the mechanism.

Figure 1A:
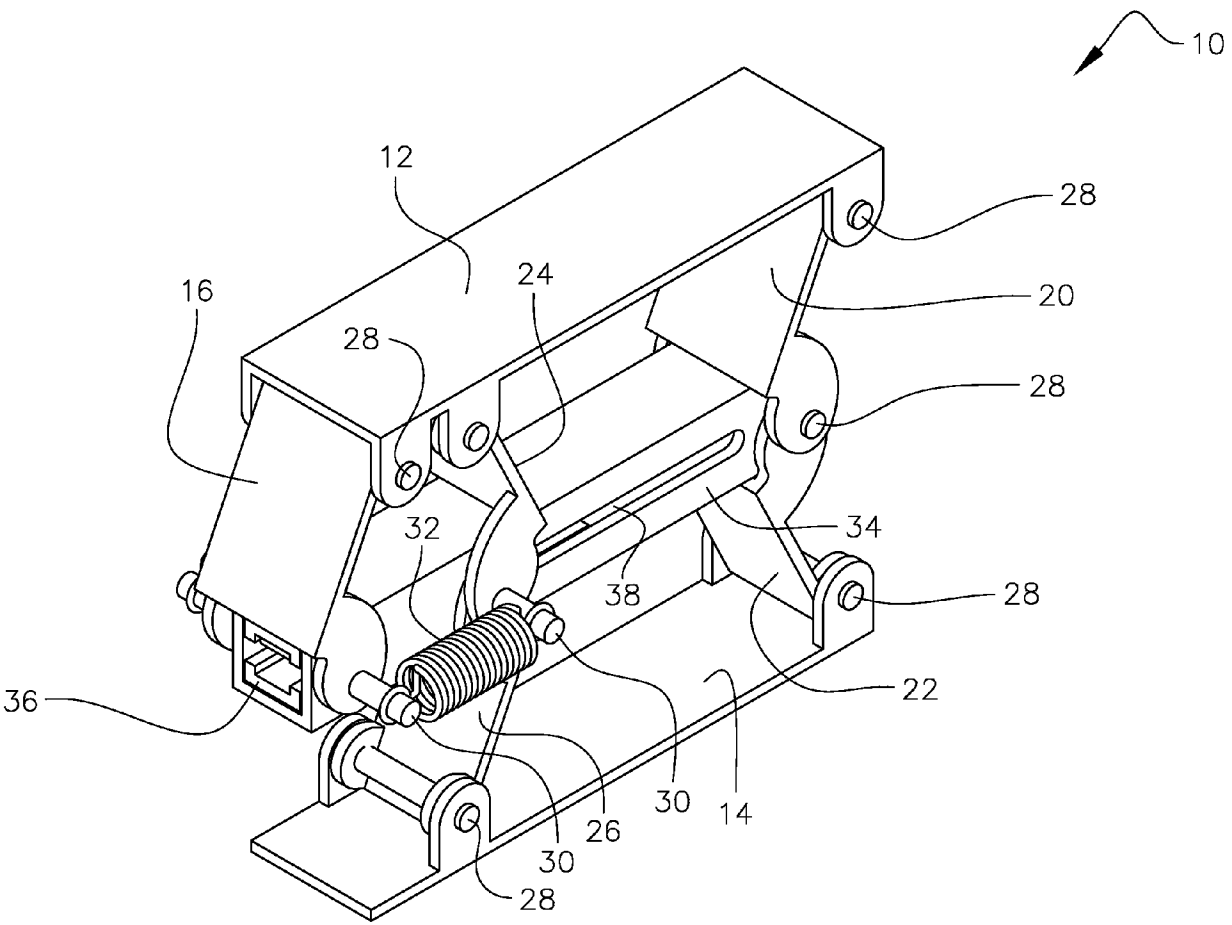
FIG. 1A illustrates a modified isometric view of a heel suspension mechanism of a first embodiment of the present invention.

Referring to FIG. 1A, an isometric view of a system of a heel suspension mechanism of a first embodiment of the present invention is shown. This slightly modified heel suspension mechanism is similar to that shown in FIG. 1, except one heel arm 18 is deleted, providing the same horizontal synchronization as the heel suspension mechanism of FIG. 1 with less moving parts. Note that in other embodiments; other heel arms 16/18/24/26/20/22 are absent as long as horizontal synchronization and structural integrity are maintained. In embodiments with multiple heel hinge mechanisms, it is possible to remove additional heels arms 16/18/24/26/20/22 while still maintaining horizontal synchronization and structural integrity.

Figure 2:
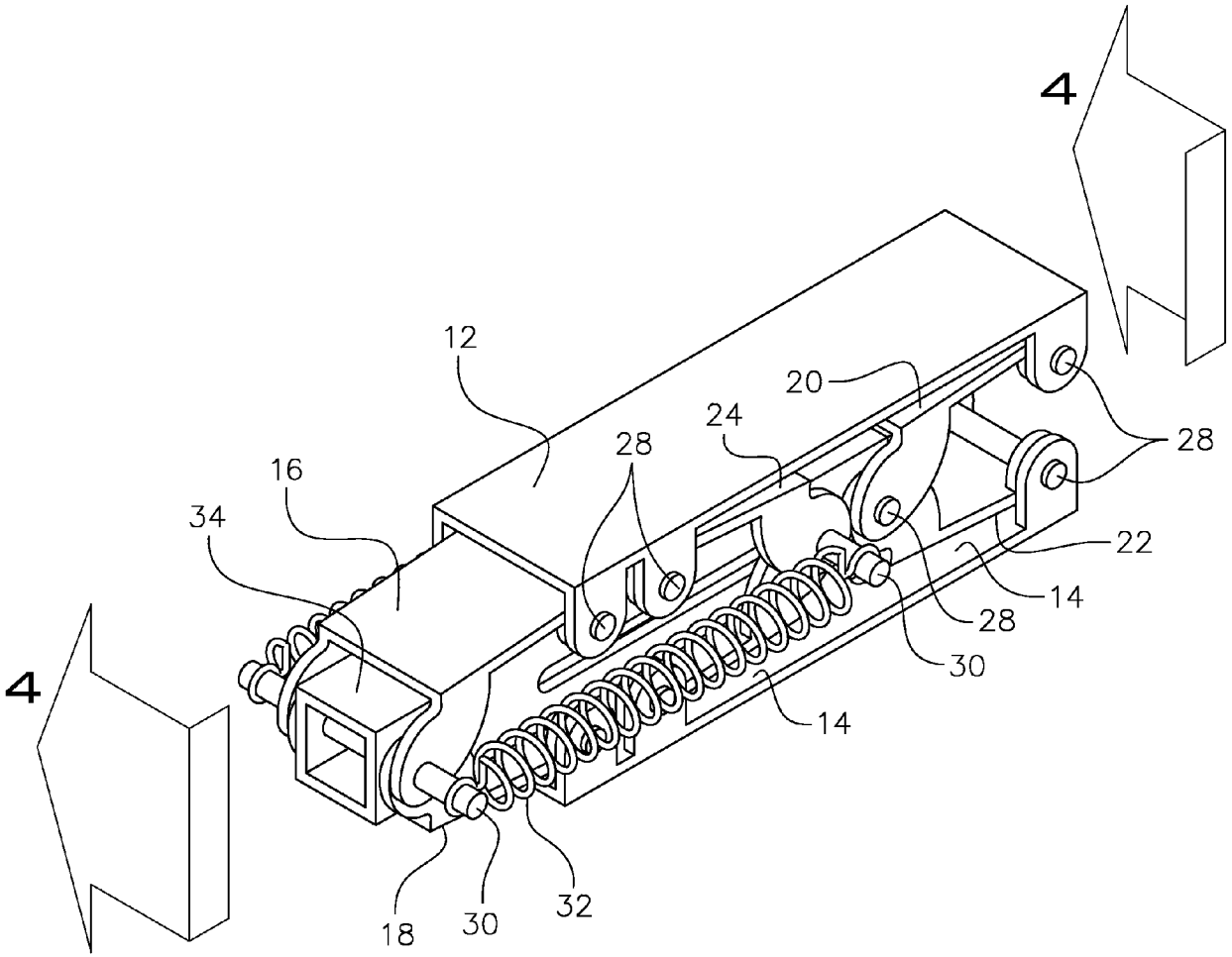
FIG. 2 illustrates an isometric view of a heel suspension mechanism of a first embodiment of the present invention in a compressed state.

Referring to FIG. 2, an isometric view of a heel suspension mechanism of a first embodiment of the present invention in a compressed state is shown. It can be seen that the pivot 30 of the second heel hinge 24/26 has traveled down the slot 38 to the end, where it can go no further, thereby preventing the suspension mechanism 10 from over-closing.

Figure 3:
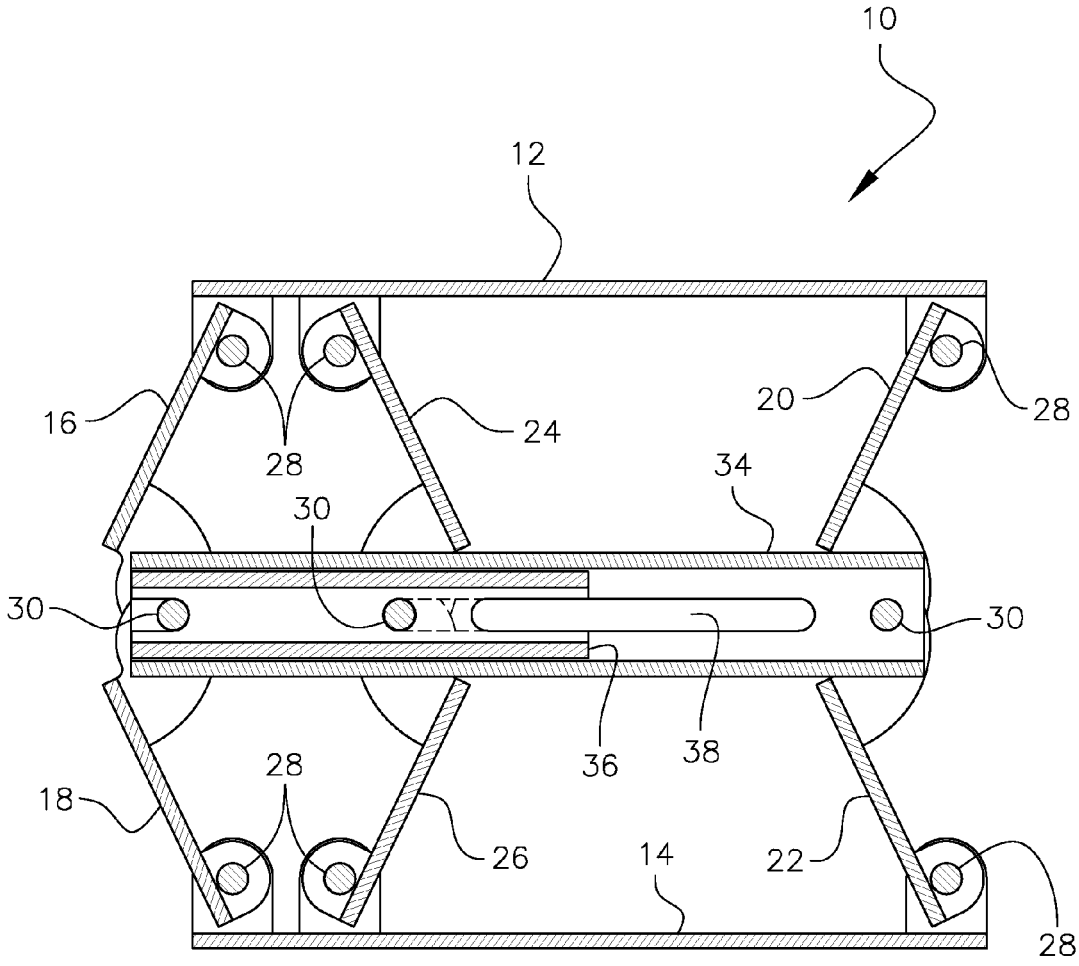
FIG. 3 illustrates a side cut-away view a heel suspension mechanism of the first embodiment of the present invention.

Referring to FIG. 3, a side cut-away view of a heel suspension mechanism of the first embodiment of the present invention is shown. In this, it can be seen that the first heel hinge 16/18 and second heel hinge 24/26 are kept from opening fully because their pivot pins 30 are held apart by the inner coupling 36.

Figure 3A:
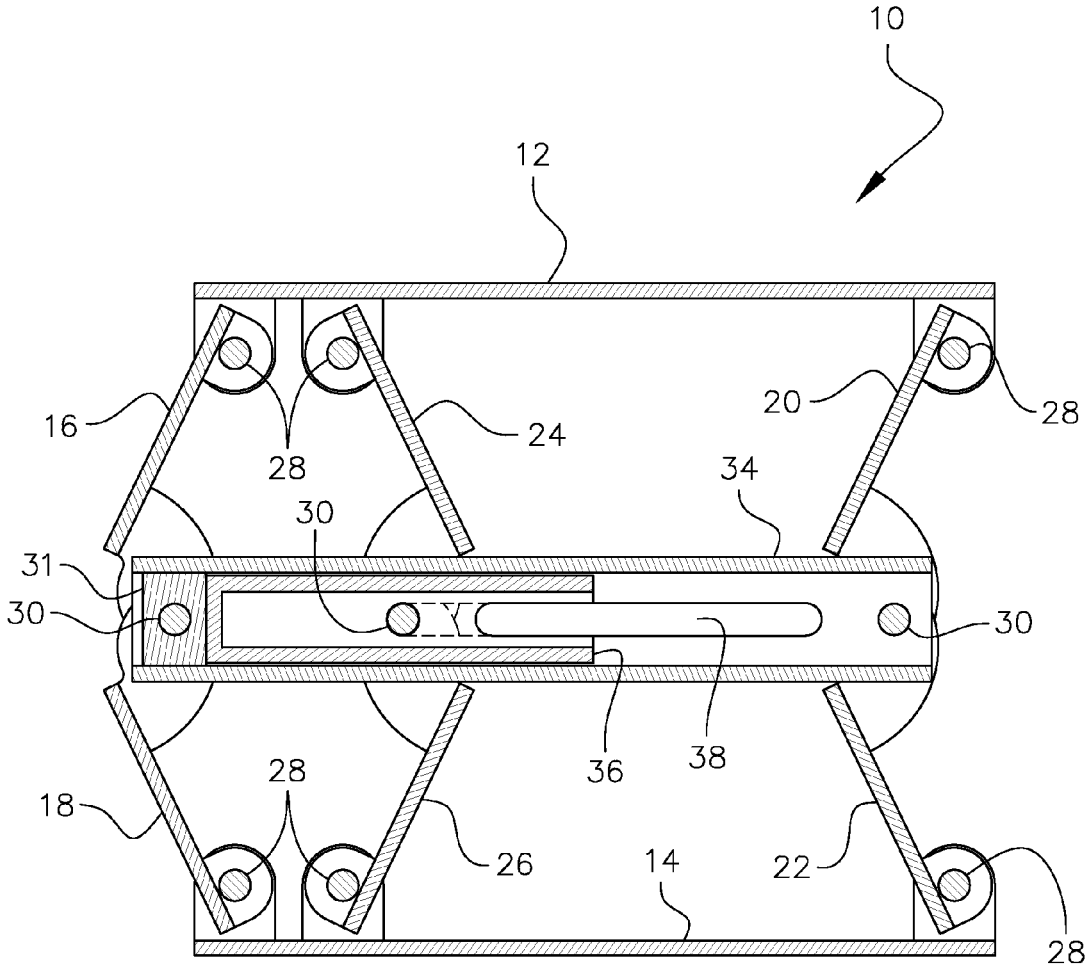
FIG. 3A illustrates a cross-sectional view along line 3-3 of FIG. 1 of a heel suspension mechanism of the first embodiment of the present invention with a motion limiter.

Referring to FIG. 3A, a cross-sectional view along line 3-3 of FIG. 1 of a heel suspension mechanism of the first embodiment of the present invention with integrated range of motion limiter. In this, it can be seen that the first heel hinge 16/18 and second heel hinge 24/26 are kept from opening fully because their pivot pins 30 are held apart by the inner coupling 36. In this embodiment, a stop 31 is situated within the outer coupling 34, held in place by the pivot pin 30. The stop 31 prevents the inner coupling 36 from traveling to far within the outer coupling 34, thereby restricting the degree to which the hinges 16/18/24/26/20/22 open, maintaining at least a partial closure.

Figure 4:
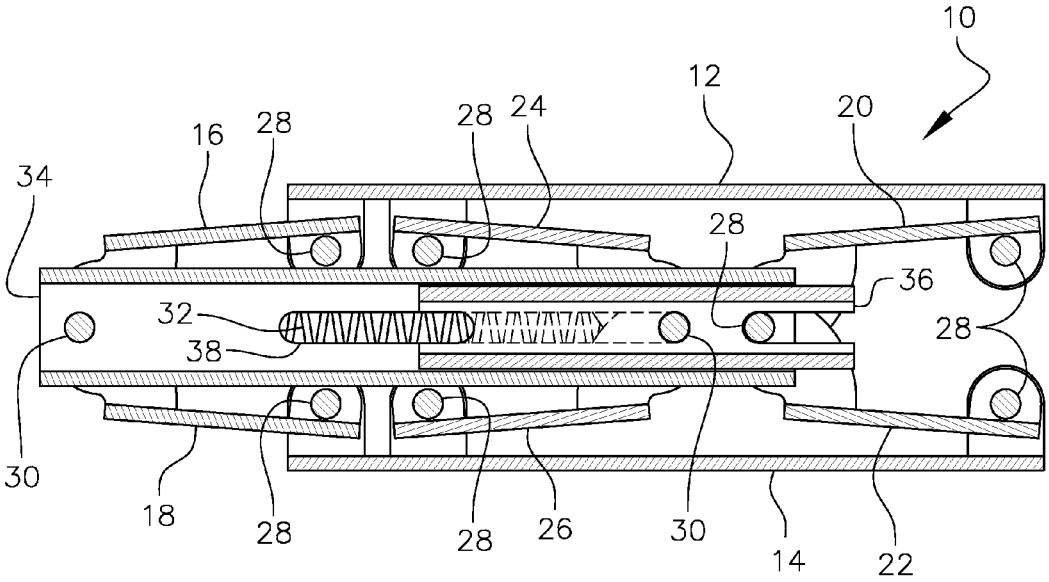
FIG. 4 illustrates a cross-sectional view along line 4-4 of FIG. 2 of a heel suspension mechanism of the first embodiment of the present invention in a compressed state using extension springs.

Referring to FIG. 4, a side cross-sectional view along line 4-4 of FIG. 2 of a heel suspension mechanism of the first embodiment of the present invention using an extension spring is shown in a compressed state. The extension spring 32 is visible through the slot 38 of the coupling tubes 34/36 and is coupled at one end to the pivot 30 of the first heel hinge 16/18 and coupled at the opposite end to the pivot 30 of the second heel hinge 24/26.

Figure 5:
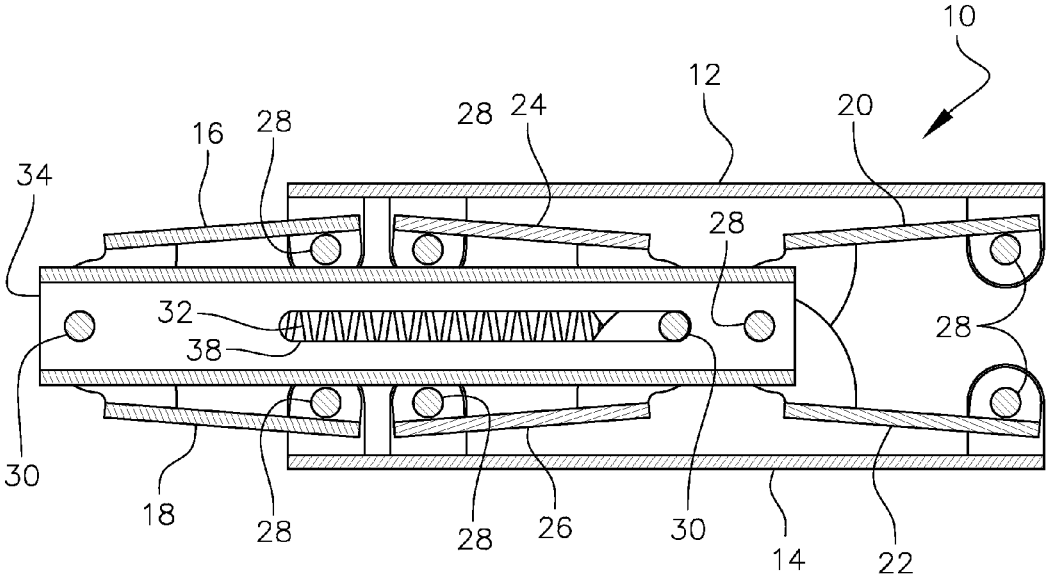
FIG. 5 illustrates a side schematic view of a heel suspension mechanism of the first embodiment of the present invention in a compressed state using extension springs but no inner coupling tube.

Referring to FIG. 5, a side schematic view of a heel suspension mechanism of the first embodiment of the present invention in a compressed state is shown using extension spring but without an inner coupling tube. The heel suspension mechanism 10 of FIG. 5 is simplified by eliminating the inner coupling tube 36 and relying upon the pivot 30 traveling in the slot 38 to enforce the parallel relationship and horizontal synchronization between the top plate 12 and the bottom plate 14. Although, injecting additional friction into the system, the embodiment of FIG. 5 maintains the parallel relationship and horizontal synchronization between the top plate 12 and the bottom plate 14 with less parts and reduced costs.

Figure 6:
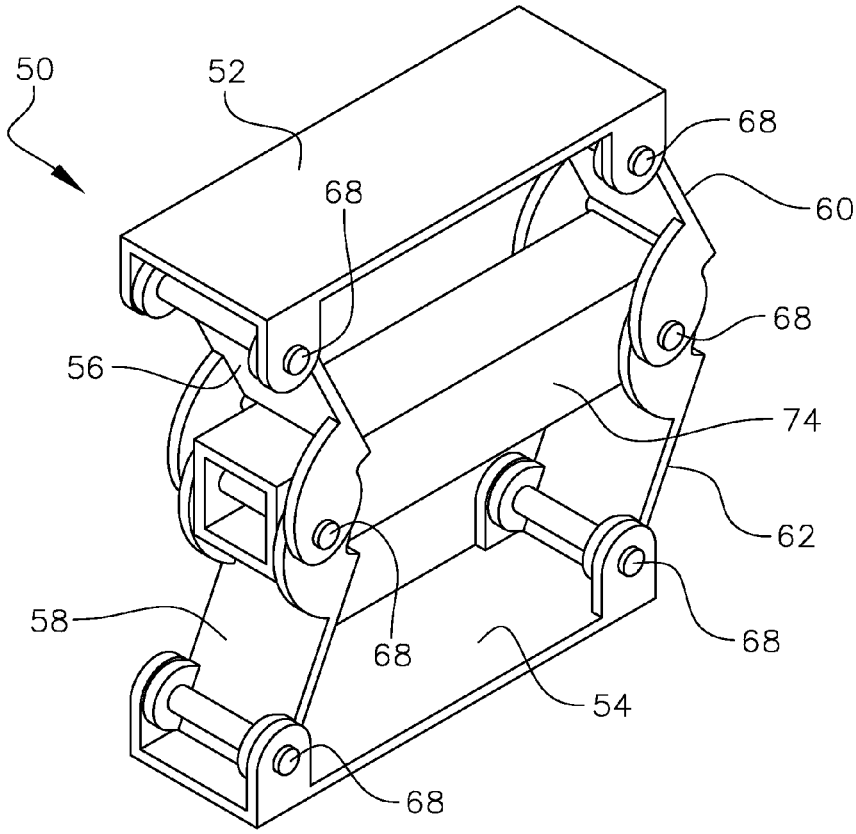
FIG. 6 illustrates an isometric view of a toe suspension mechanism of the first embodiment of the present invention.

Referring to FIG. 6, an isometric view of a toe suspension mechanism of the first embodiment of the present invention is shown. The toe suspension mechanism of FIGS. 6-7 links the upper toe sole to the lower toe sole and provides control to the lower toe sole such that when integrated into a shoe along with the heel suspension mechanism of FIGS. 1-5, the upper toe sole remains parallel yet slides forward/backward with respect to the lower toe sole as maintained by the movement of the heel suspension mechanism 10. The upper and lower sole remain parallel throughout the heel suspension's entire range of movement and throughout the toe sole's entire range of pivoting around the heel suspension.

To achieve this longitudinal stability, the toe suspension mechanism 50 includes a top toe plate 52 that is affixed to an upper toe sole (not shown) and a bottom toe plate 54 that is affixed to a lower toe sole (not shown). The top toe plate 52 and bottom toe plate 54 are supported by two toe hinges, although additional toe hinges are envisioned if needed. Both toe hinges close in the same direction, preferably towards the heel area. The first toe hinge consists of two toe arms 56/58 hingedly coupled to the top toe plate 52 and bottom toe plate 54 by pivots 68. It should be noted that the pivots 68 can be any hinge/pivot known in the industry including screws/bolts, shafts/retainer-rings and rivets. The hinge arms 56/58 are hingedly connected to each other by another hinge pivot 68. A second toe hinge consists of two arms 60/62, also hingedly coupled to the top toe plate 52 and bottom toe plate 54 by pivots 68. The hinge arms 60/62 are hingedly connected to each other by another hinge pivot 68. The toe hinges (56/58, 60/62) are coupled to each other by a rigid toe coupling 74 that is pivotally connected to the pivot 68 of the each hinge (56/58, 60/62). In this example, the rigid toe coupling 74 is in the form of a coupling tube 74, though other forms of rigid toe couplings are anticipated. The toe coupling 74 maintains the distance between the pivots 68 of both hinges (56/58, 60/62).

Figure 7:
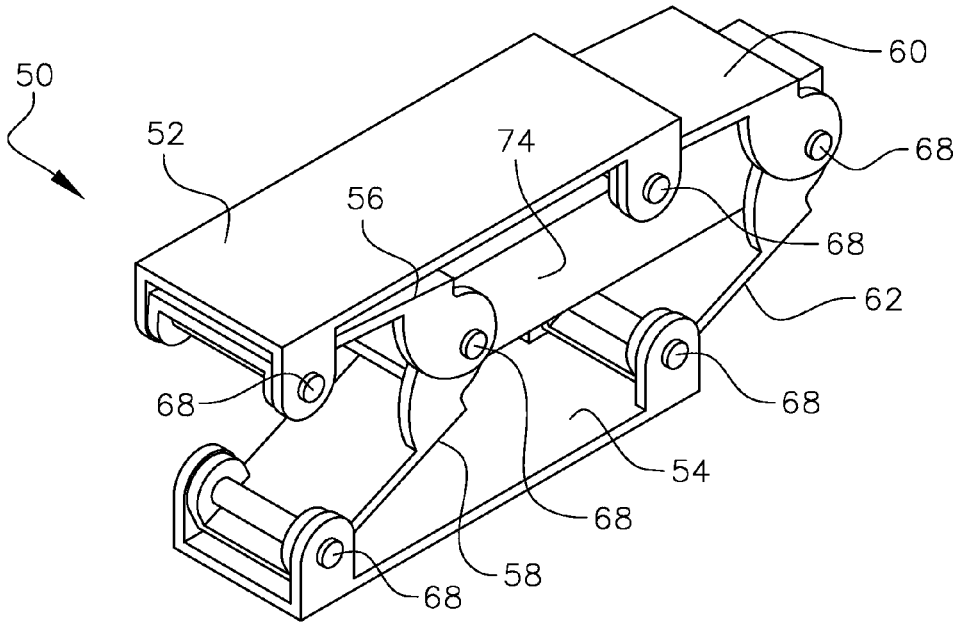
FIG. 7 illustrates an isometric view of a toe suspension mechanism of the first embodiment of the present invention in a compressed state.

Referring to FIG. 7, an isometric view of a toe suspension mechanism of the first embodiment of the present invention in a compressed state is shown. Note that the distance between the pivots 68 of both toe hinges (56/58, 60/62) is the same as in FIG. 6.

Figure 8:
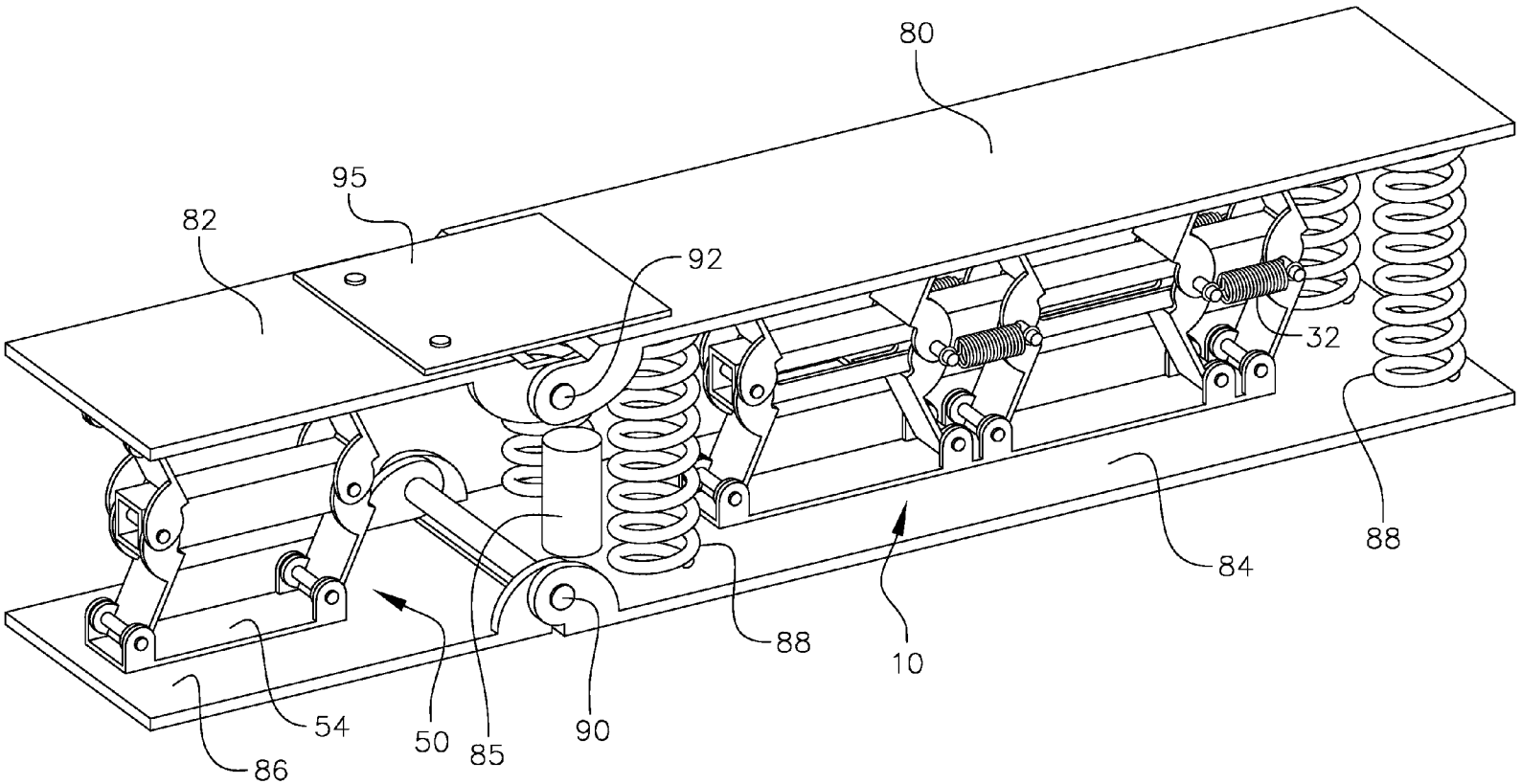
FIG. 8 illustrates an isometric view of a heel and toe energy-return system of the first embodiment of the present invention integrated with coil springs and extension springs.

Referring to FIG. 8, an isometric view of a heel and toe energy-return system of the first embodiment of the present invention integrated with coil springs and extension springs is shown. In this example, a heel suspension mechanism 10 and a toe suspension mechanism 50 are integrated between support plates. The toe suspension mechanism 50 is integrated between the upper toe support plate 82 and the lower toe support plate 86, in that the top surface of the top toe plate 52 is affixed to the bottom surface of the upper toe support plate 82 and bottom surface of the bottom toe plate 54 is affixed to the top surface of the lower toe support plate 86. Likewise, the heel suspension mechanism 10 is integrated between the upper heel support plate 80 and the lower heel support plate 84, in that the top surface of the top heel plate 12 is affixed to the bottom surface of the upper heel support plate 80 and bottom surface of the bottom heel plate 14 is affixed to the top surface of the lower heel support plate 84. In this example, the heel suspension mechanism has five heel hinges and two extension springs 32 on each side. In some embodiments, the extension springs are not used.

The upper toe support plate 82 is pivotally (as shown) or bendably (not shown) coupled to the upper heel support plate 80, in some embodiments by a pivot 92. The lower toe support plate 86 is pivotally or bendably coupled to the lower heel support plate 84, in some embodiments by a pivot 90. In some embodiments, a flexible interface cover plate 95 prevents the sole of the shoe (not shown) from getting pinched and worn. In this example, the upper heel support plate 80 and the lower heel support plate 84 are pushed apart by compression or coil springs 88 as well as extension springs 32. Again, in some embodiments, a single type of springs is used such as a coil spring 88 or an extension spring 32, depending upon the application. Because different spring types have different force curves, there are many advantages in using a mix of different spring types as well as different spring values. In some embodiments, a motion limiter 85, preferably made of a stiff, energy absorbing material such as rubber is positioned between the upper heel support plate 80 and the lower heel support plate 84; thereby reducing the impact of fully compressing the sole and the possibility of damage to the springs should excessive force be applied.

In some embodiments the upper toe support plate 82 is pivotally coupled to the upper heel support plate 80 by a pivot 92 and the lower toe support plate 86 is pivotally coupled to the lower heel support plate 84 by a pivot 90. In this embodiment, any heel energy return mechanism(s) or heel support structure(s) as described here within or as described in the prior art is/are disposed between the upper heel support plate 80 and the lower heel support plate 84. Likewise, any toe energy return mechanism(s) or toe support structure(s) as described here within or as described in the prior art is/are disposed between the upper toe support plate 82 and the lower toe support plate 86. The pivots 90/92 allow the toe plates to pivotally bend with respect to the heel plates at a locale beneath the metatarsal area of a wearer's foot while providing for the ability of one or both sets of upper support plates 80/82 to slide forward or back with respect to one or both sets of lower support plates 84/86. In some embodiments, a flexible interface cover plate 95 prevents the sole or inner sole of the shoe from getting pinched and worn. In some embodiments, the flexible interface cover plate 95 is a torsion spring for helping the toe soles align with the heel soles.

Figure 8A:
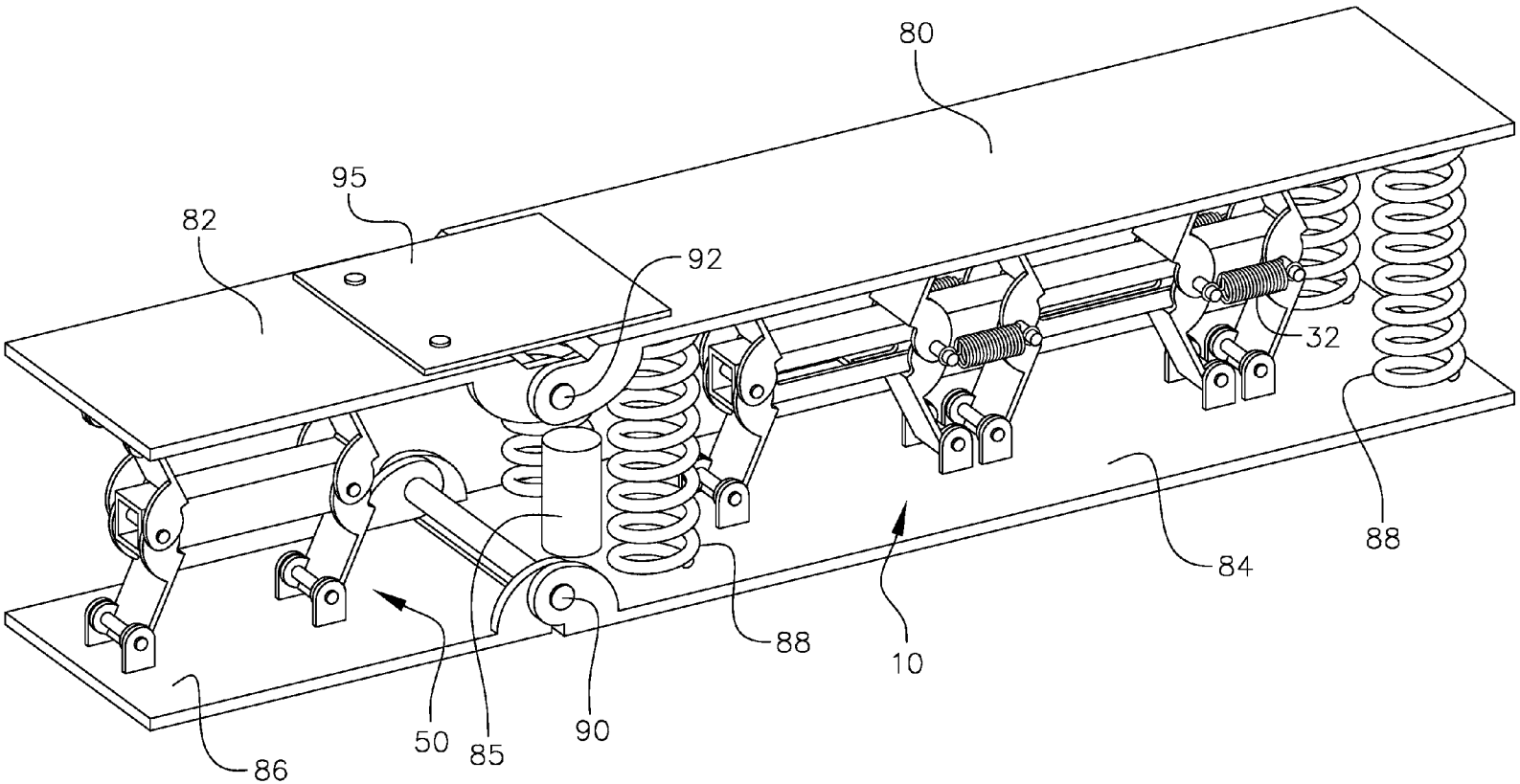
FIG. 8A illustrates an isometric view of a modified heel and toe energy-return system of the first embodiment of the present invention integrated with coil springs and extension springs.

Referring to FIG. 8A, an isometric view of a modified heel and toe energy-return system of the first embodiment of the present invention integrated with coil springs and extension springs is shown. In this example, a heel suspension mechanism 10 and a toe suspension mechanism 50 are integral to the upper and lower toe and heel support plates 82/86/80/84. The toe suspension mechanism 50 is connected to the upper toe support plate 82 and the lower toe support plate 86, in that the upper toe support plate 82 is the top toe plate 52 and the lower toe support plate 86 is the bottom toe plate 54. Likewise, the heel suspension mechanism 10 is integrated into the upper heel support plate 80 and the lower heel support plate 84, in that the upper heel support plate 80 is the top heel plate 12 and the lower toe support plate 84 is the bottom heel plate 14.

Figure 9:
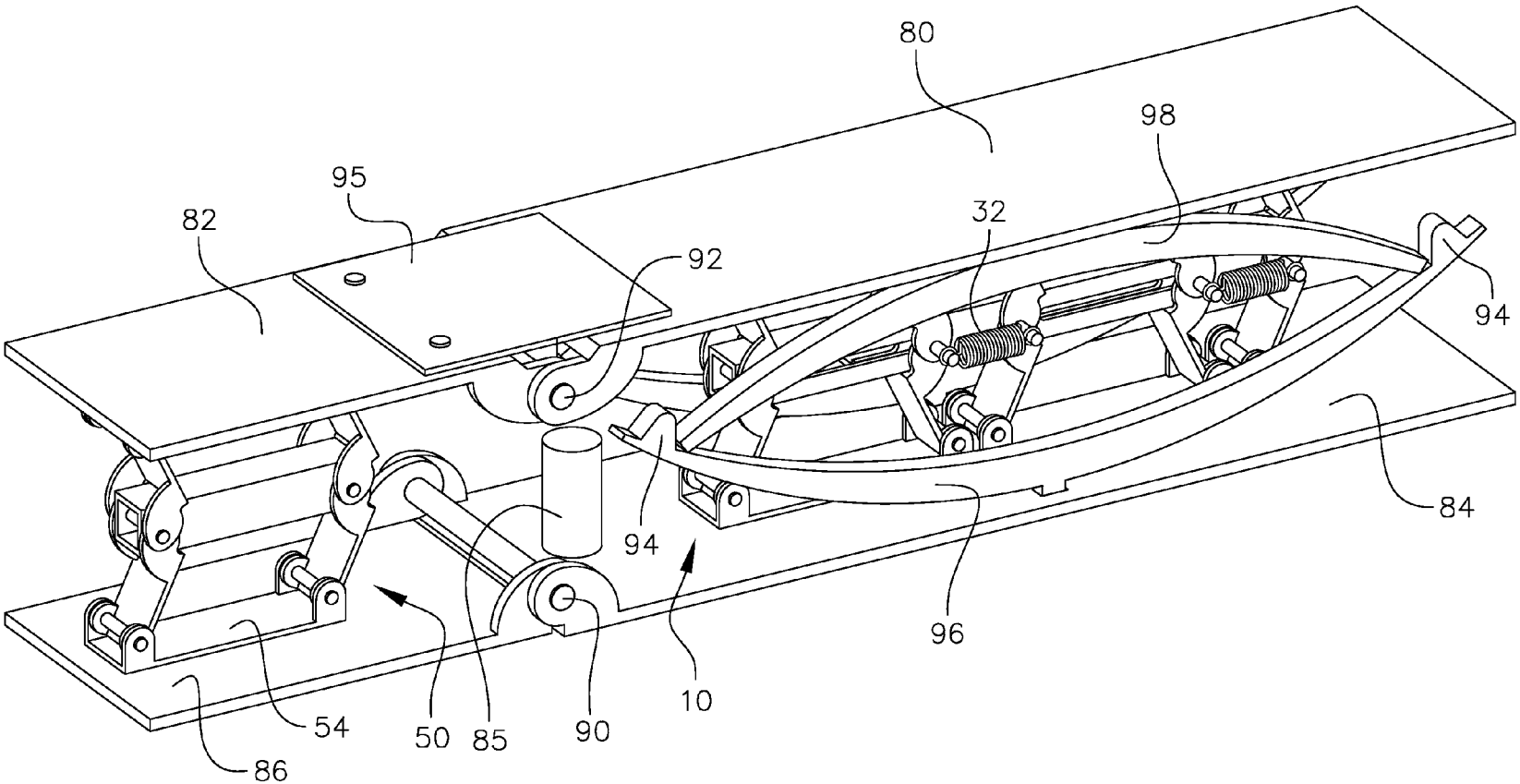
FIG. 9 illustrates an isometric view of a heel and toe energy-return system of the first embodiment of the present invention integrated with leaf springs and extension springs.

Referring to FIG. 9, an isometric view of a heel and toe energy-return system of the first embodiment of the present invention integrated with leaf springs and extension springs is shown. In this example, leaf springs 96 are used instead of compression springs 88 as in FIG. 8. As in the example of FIG. 8, a heel suspension mechanism 10 and a toe suspension mechanism 50 are integrated between support plates. The toe suspension mechanism 50 is integrated between the upper toe support plate 82 and the lower toe support plate 86, in that the top surface of the top toe plate 52 is affixed to the bottom surface of the upper toe support plate 82 and bottom surface of the bottom toe plate 54 is affixed to the top surface of the lower toe support plate 86. Likewise, the heel suspension mechanism 10 is integrated between the upper heel support plate 80 and the lower heel support plate 84, in that the top surface of the top heel plate 12 is affixed to the bottom surface of the lower heel support plate 80 and bottom surface of the bottom heel plate 14 is affixed to the top surface of the lower heel support plate 84. In this example, the heel suspension mechanism has five heel hinges and two extension springs. In some embodiments, the extension springs are not used.

The upper toe support plate 82 is pivotally coupled to the upper heel support plate 80 by a pivot 92 and the lower toe support plate 86 is pivotally coupled to the lower heel support plate 84 by a pivot 90. In alternate embodiments, the upper toe support plate 82 is bendably coupled to the upper heel support plate 80 and the lower toe support plate 86 is bendably coupled to the lower heel support plate 84. The upper heel support plate 80 and the lower heel support plate 84 are pushed apart by leaf springs 98 as well as extension springs 32. Again, in some embodiments, a single type of springs is used such as a leaf springs 96/98 or an extension spring 32, depending upon the application. In this exemplary leaf spring 96/98, the top leaf spring portion 98 is coupled to the bottom leaf spring 96 by protrusions 94, instead of rigidly affixing the top leaf spring portion 98 to the bottom leaf spring 96 portion, thereby improving the performance of the leaf spring 96/98.

In some embodiments, a motion limiter 85, preferably made of a stiff, energy absorbing material such as rubber, is positioned between the upper heel support plate 80 and the lower heel support plate 84; thereby reducing the possibility of damage to the springs should excessive force be applied.

Figure 10:
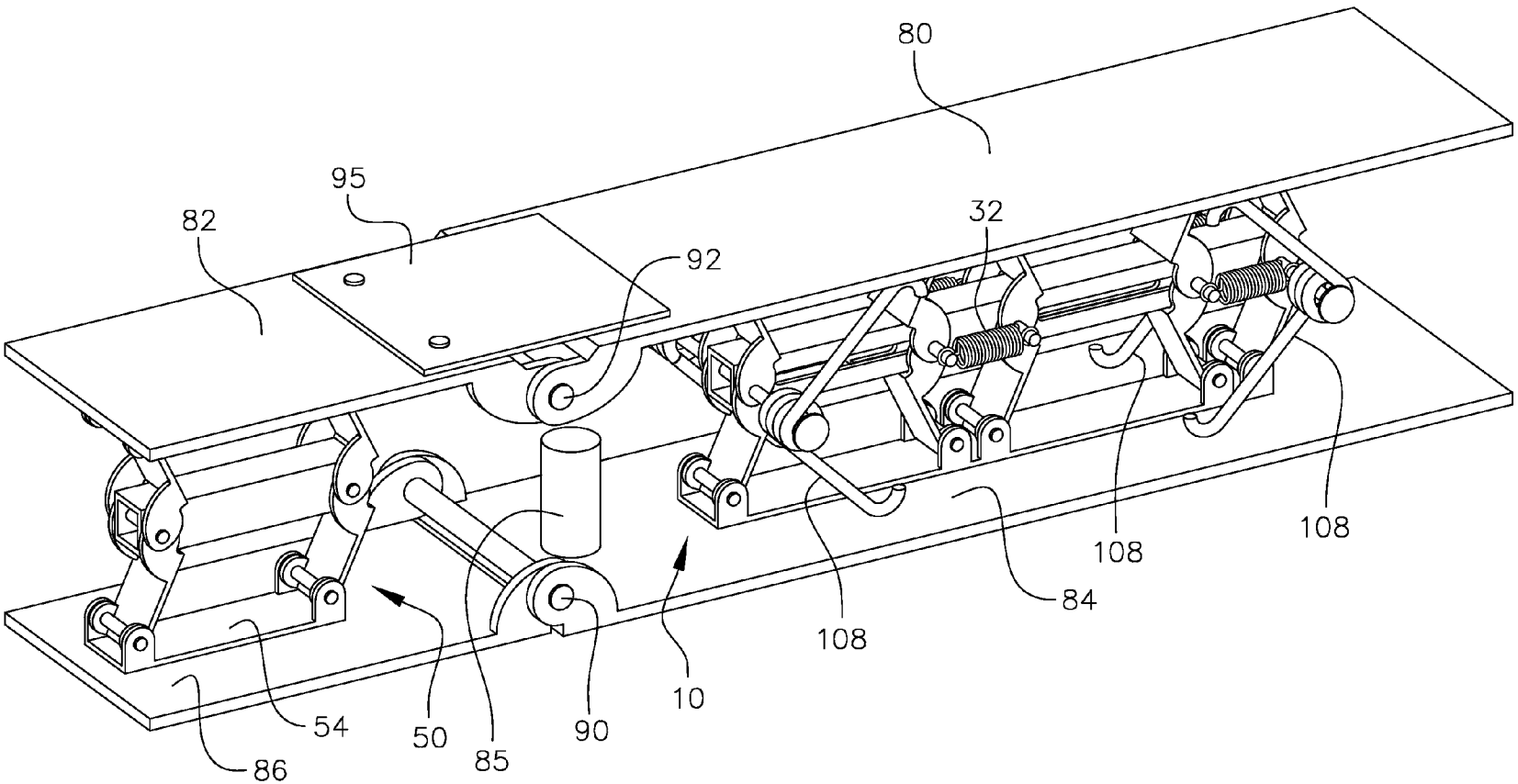
FIG. 10 illustrates an isometric view of a heel and toe energy-return system of the first embodiment of the present invention integrated with torsion springs and extension springs.

Referring to FIG. 10, an isometric view of an energy-return system of the first embodiment of the present invention integrated with torsion springs 108 and extension springs 32 is shown. In this example, torsion springs 108 are used instead of compression springs 88 as in FIG. 8. As in the example of FIG. 8, a heel suspension mechanism 10 and a toe suspension mechanism 50 are integrated between support plates. The toe suspension mechanism 50 is integrated between the upper toe support plate 82 and the lower toe support plate 86, in that the top surface of the top toe plate 52 is affixed to the bottom surface of the upper toe support plate 82 and bottom surface of the bottom toe plate 54 is affixed to the top surface of the lower toe support plate 86. Likewise, the heel suspension mechanism 10 is integrated between the upper heel support plate 80 and the lower heel support plate 84, in that the top surface of the top heel plate 12 is affixed to the bottom surface of the lower heel support plate 80 and bottom surface of the bottom heel plate 14 is affixed to the top surface of the lower heel support plate 84. In this example, the heel suspension mechanism has five heel hinges and two extension springs. In some embodiments, the extension springs are not used.

The upper toe support plate 82 is pivotally coupled to the upper heel support plate 80 by a pivot 92 and the lower toe support plate 86 is pivotally coupled to the lower heel support plate 84 by a pivot 90. In alternate embodiments, the upper toe support plate 82 is bendably coupled to the upper heel support plate 80 and the lower toe support plate 86 is bendably coupled to the lower heel support plate 84. The upper heel support plate 80 and the lower heel support plate 84 are pushed apart by torsion springs 108 as well as extension springs 32. In some embodiments, a single type of springs is used such as a torsion springs 108 or an extension spring 32, depending upon the application.

It should be noted that, although the torsion springs 108 and the extension springs 32 are shown outside of the hinges, alternate embodiments have the torsion springs located within the hinges (16/18, 24/26, 20/22) and the extension springs 32 within the inner/outer couplings 34/36.

In some embodiments, a motion limiter 85, preferably made of a stiff, energy absorbing material such as rubber, is positioned between the upper heel support plate 80 and the lower heel support plate 84; thereby reducing the possibility of damage to the springs should excessive force be applied.

Figure 11:
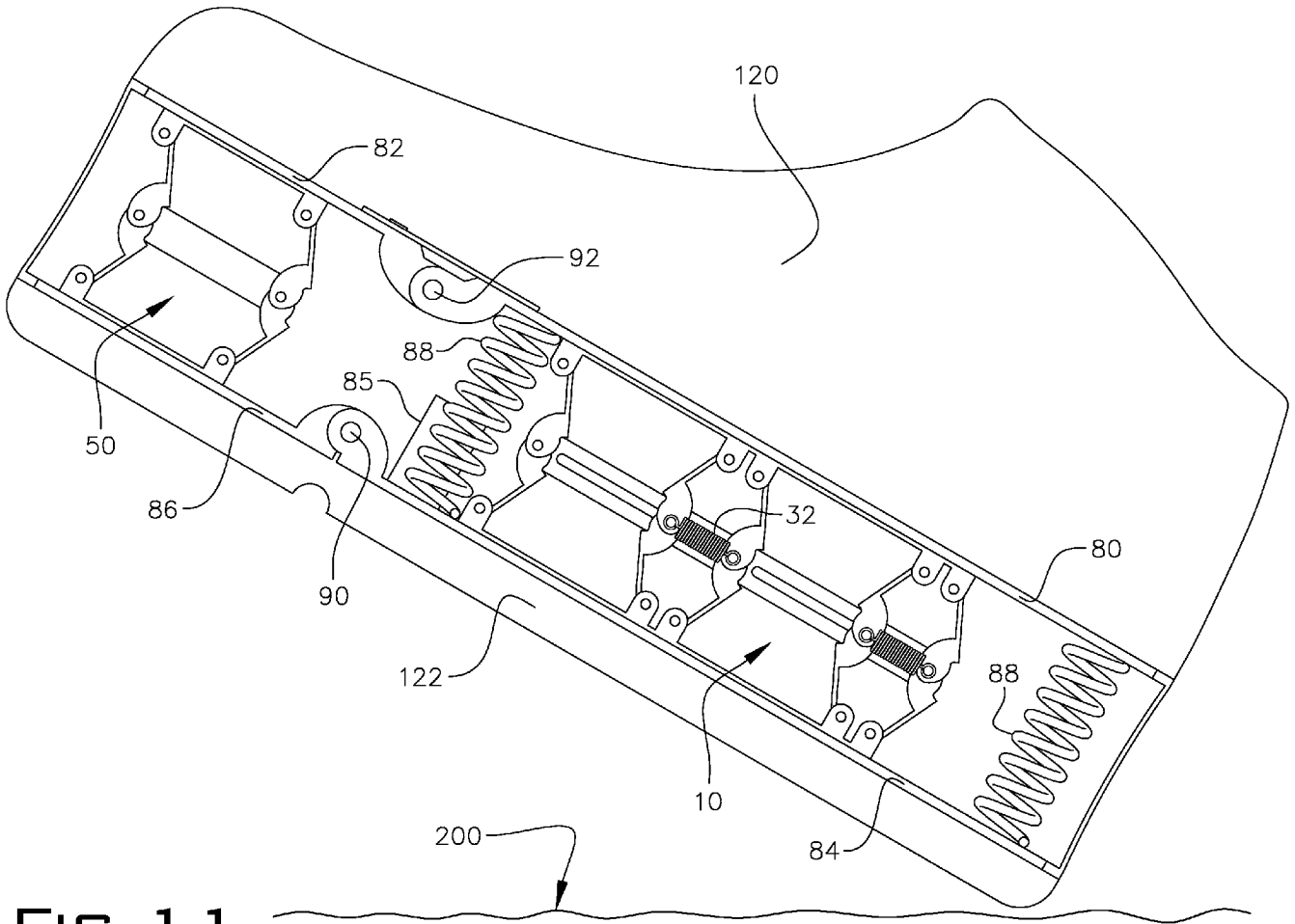
FIG. 11 illustrates a side schematic view of the energy-return system of the first embodiment of the present invention integrated with a shoe-part before the heel contacts the surface.
Figure 12:
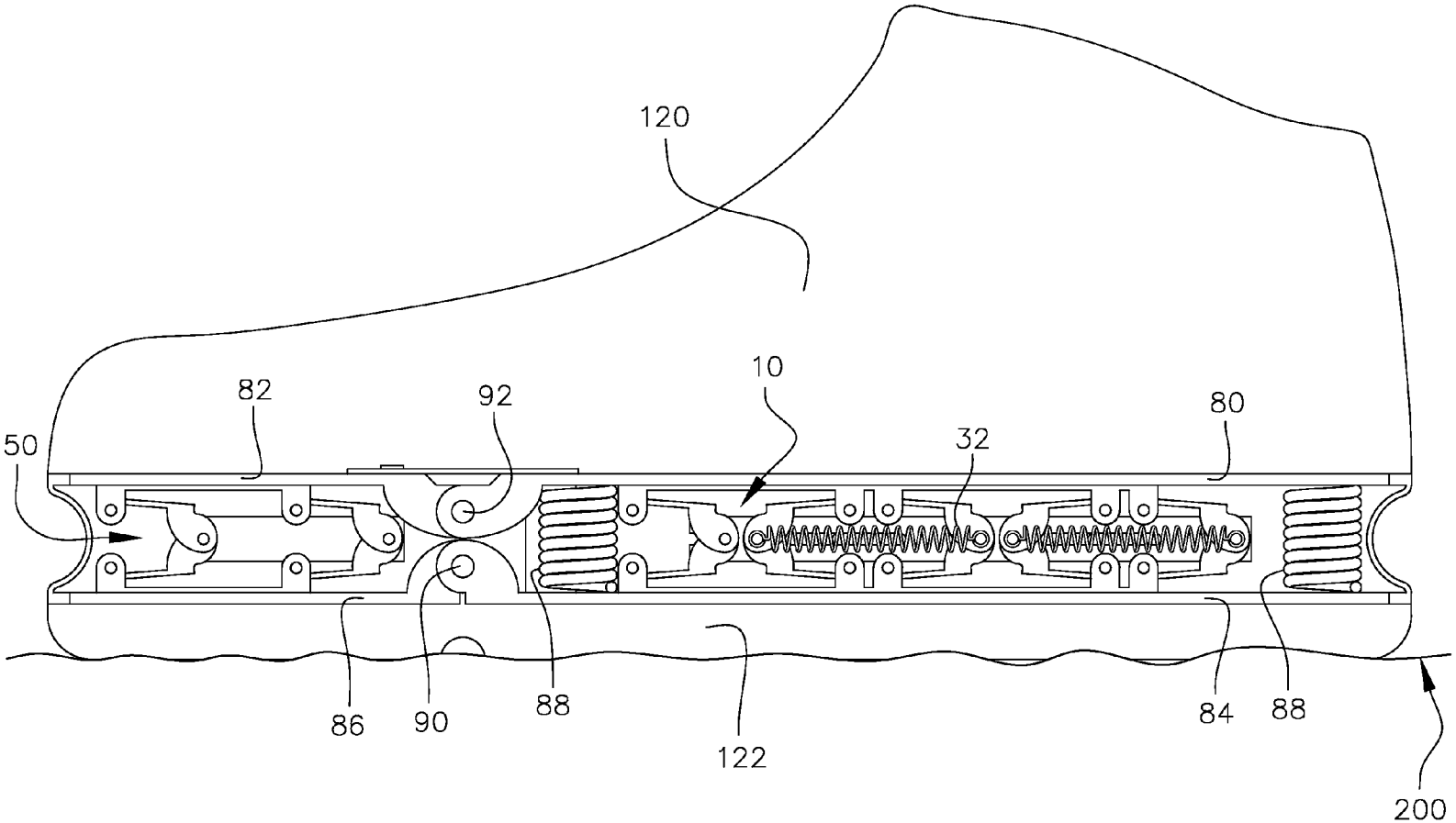
FIG. 12 illustrates a side schematic view of the energy-return system of the first embodiment of the present invention integrated with a shoe-part after the heel contacts the surface.
Figure 13:
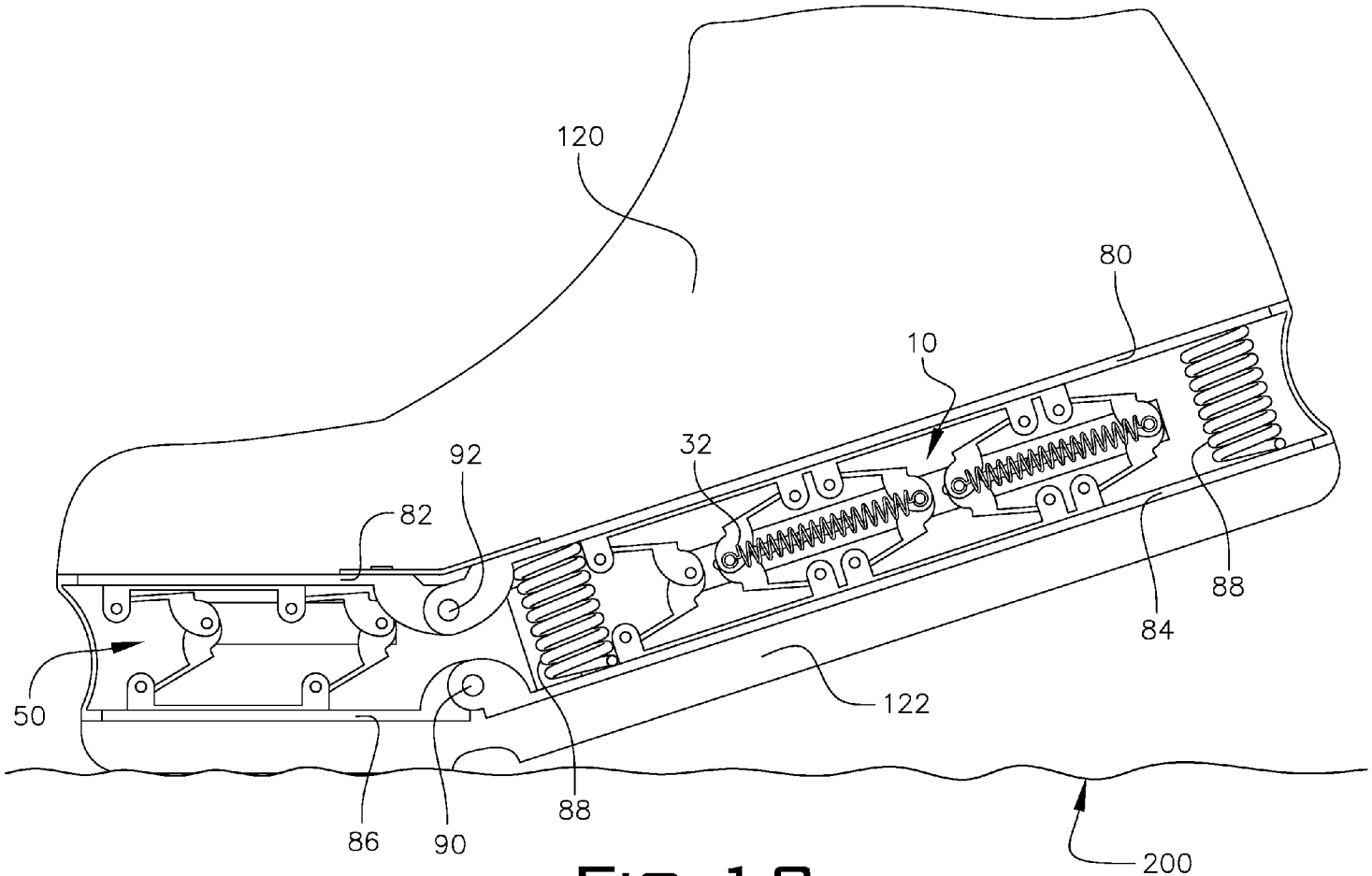
FIG. 13 illustrates a side schematic view of the energy-return system of the first embodiment of the present invention integrated with a shoe-part before the toe releases contact with the surface.

FIGS. 11-13 show an energy-return system of the present invention in operation. Referring to FIG. 11, a side schematic view of the energy-return system of the first embodiment of the present invention integrated with a shoe-part 120 before the heel contacts the surface is shown. Before contact with the surface 200, the springs (in this example compression springs 88 and extension springs 32) push apart the upper heel support plate 80 and the lower heel support plate 84, while the heel suspension mechanism 10 maintains a parallel, horizontally synchronized relationship between the upper heel support plate 80 and the lower heel support plate 84. The upper toe support plate 82 and the lower toe support plate 86 are supported by the toe suspension mechanism 50 and maintain a parallel relationship.

Referring to FIG. 12, a side schematic view of the energy-return system of the first embodiment of the present invention integrated with a shoe-part 120 after the heel contacts the surface is shown. The force of the wearer's step has compressed the compression springs 88 and stretched the extension springs 32, thereby cushioning the wearer's foot/leg impact, as well as storing energy in the springs 88/32. The shoe system maintains a parallel, horizontally synchronized relationship between the upper sole and bottom sole, thereby transferring heel compression forces to the toe and improving control.

Referring to FIG. 13, a side schematic view of the energy-return system of the first embodiment of the present invention integrated with a shoe-part before the toe releases with the surface is shown. At this point in the step, the energy stored in the springs 32/88 is being released, pushing the wearer's foot off the surface 200, thereby returning some of the energy of their initial down-step into lift-off energy. The returned energy provides extra speed or distance ability to the wearer. Note that the upper toe support plate 82 has moved forward relative to the lower toe support plate 86 and the pivot 92 is forward of the pivot 90 relative to a line that is perpendicular to the ground. This is necessary to account for bending of the toe as the wearer steps off the surface 200 and made possible by the hinges of the toe suspension mechanism 50.

Figure 14:
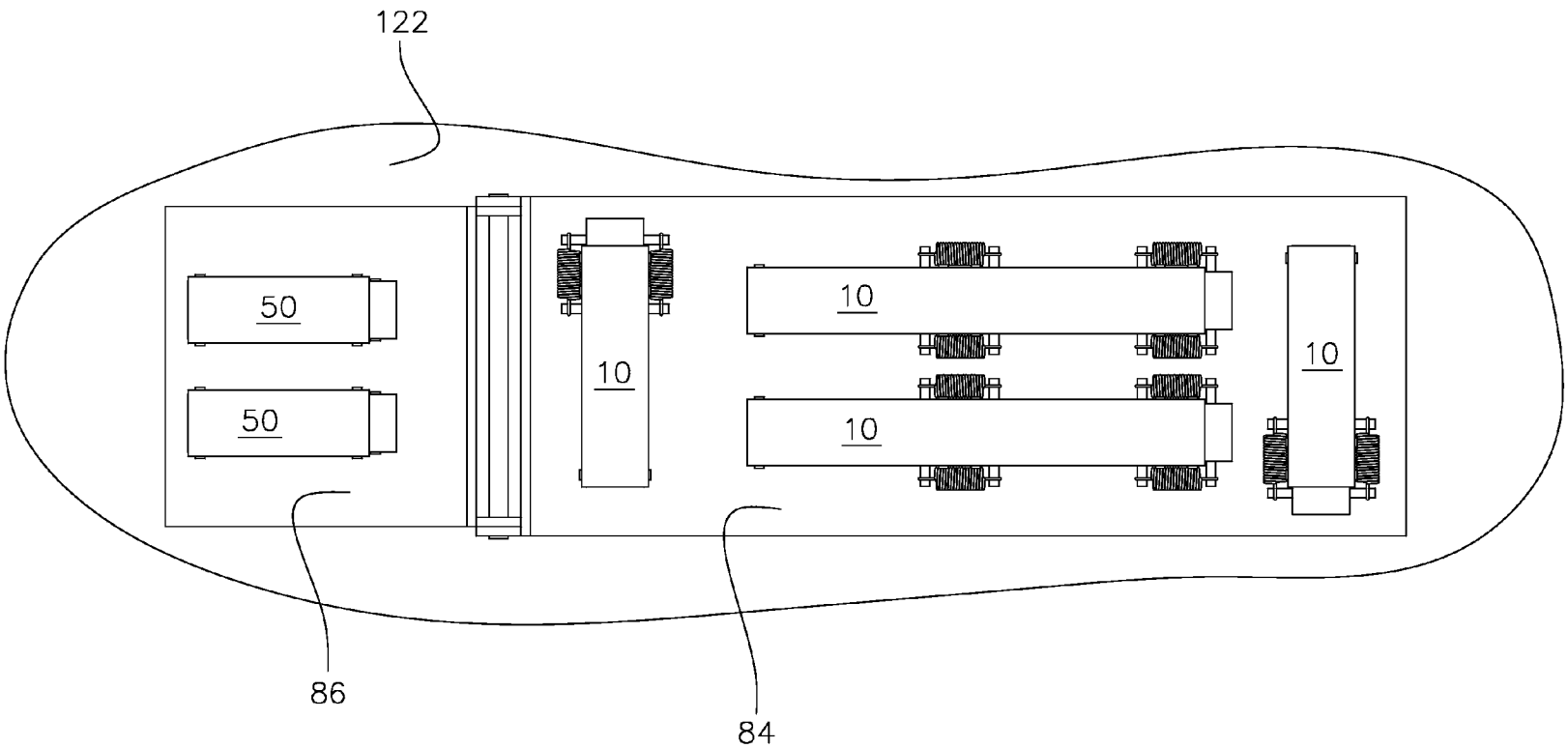
FIG. 14 illustrates a top schematic view of one configuration of the suspension mechanisms of the first embodiment of the present invention.

Referring to FIG. 14, a top schematic view of the sole of a first exemplary configuration of the energy-return system is shown. In previous examples, a minimal configuration consisting of a single toe suspension mechanism 50 and a single heel suspension mechanism 10 was shown. In this example, two toe suspension mechanisms 50 are affixed to the lower toe support plate 86 and four heel suspension mechanisms 10 are affixed to the lower heel support plate 84, two positioned laterally and two positioned longitudinally in fashion. The upper toe plate 82 and upper heel plate 80 are not shown for clarity purposes. It should be noted that it is preferred that the lower sole 122 be made from a flexible material such as leather or rubber and made wider and longer than the lower toe support plate 86 and the lower heel support plate combined. This provides cushioning support on uneven surfaces and helps the wearer maintain traction when moving laterally. Additionally, this lower sole design also helps prevent ankle sprains as the inflexible contact patch is narrowed (akin to a bare foot), while the overall contact area is broader.

Figure 15:
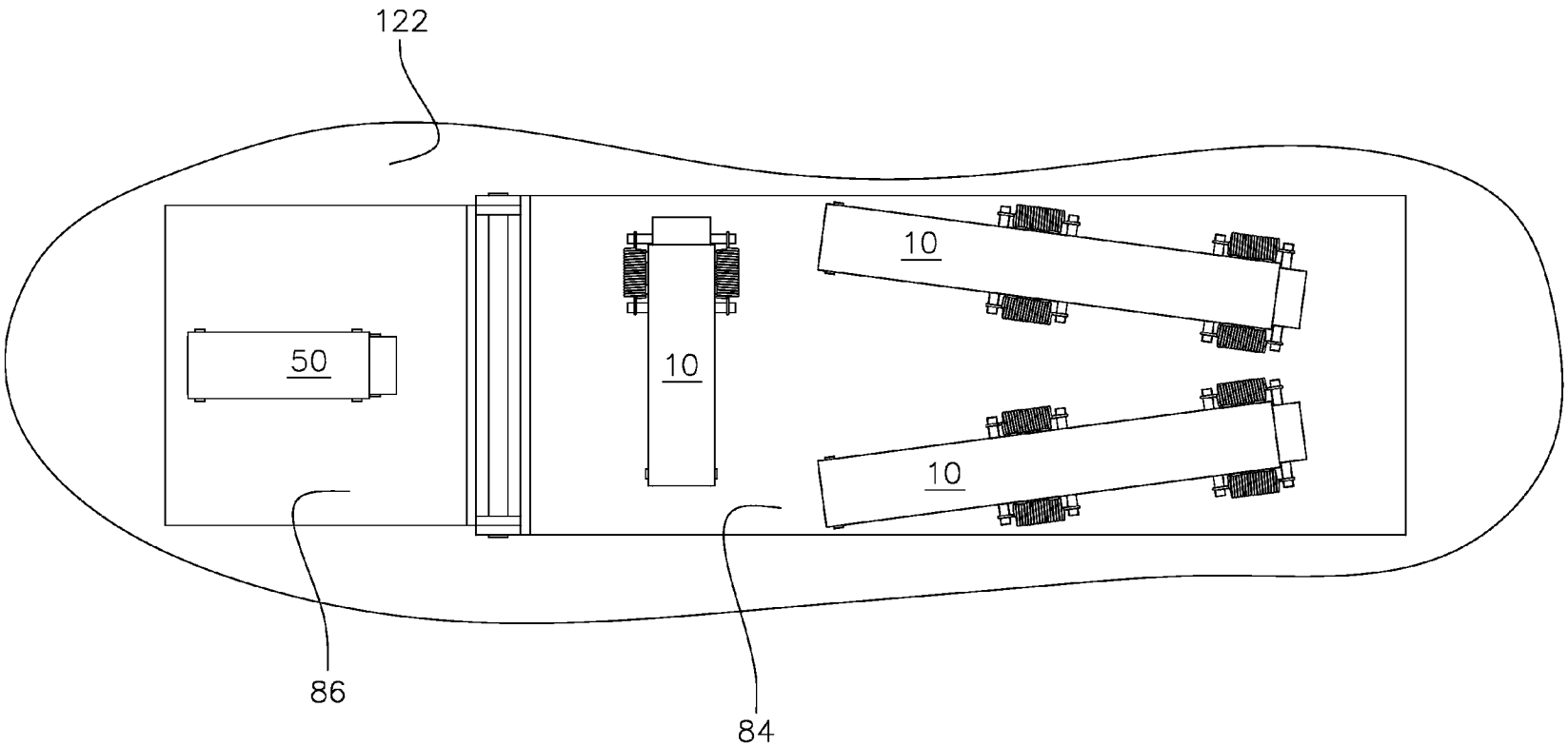
FIG. 15 illustrates a top schematic view of another configuration of the suspension mechanisms of the first embodiment of the present invention.

Referring to FIG. 15, a schematic view looking from the top of the sole of a second exemplary configuration of the energy-return system of the first embodiment of the present invention is shown. In the example of FIG. 14, a configuration consisting of two-toe suspension mechanism 50 and a four-heel suspension mechanism was shown. In this example, one toe suspension mechanism 50 is affixed to the lower toe support plate 86 and three heel suspension mechanisms 10 are affixed to the lower heel support plate 84, one positioned laterally and two positioned longitudinally in fashion. Again, the upper toe plate 82 and upper heel plate 80 are not shown for clarity purposes and, it should be noted that it is preferred that the lower sole 122 be wider and longer than the combined lower toe support plate 86 and the lower heel support plate. This provides cushioning support on uneven surfaces and helps the wearer maintain traction when moving laterally. Many other configurations of toe suspension mechanisms 50 and heel suspension mechanisms 10 are equally viable and include, for example, two perpendicular and two parallel mechanisms, two parallel and one perpendicular, etc.

Figure 16:
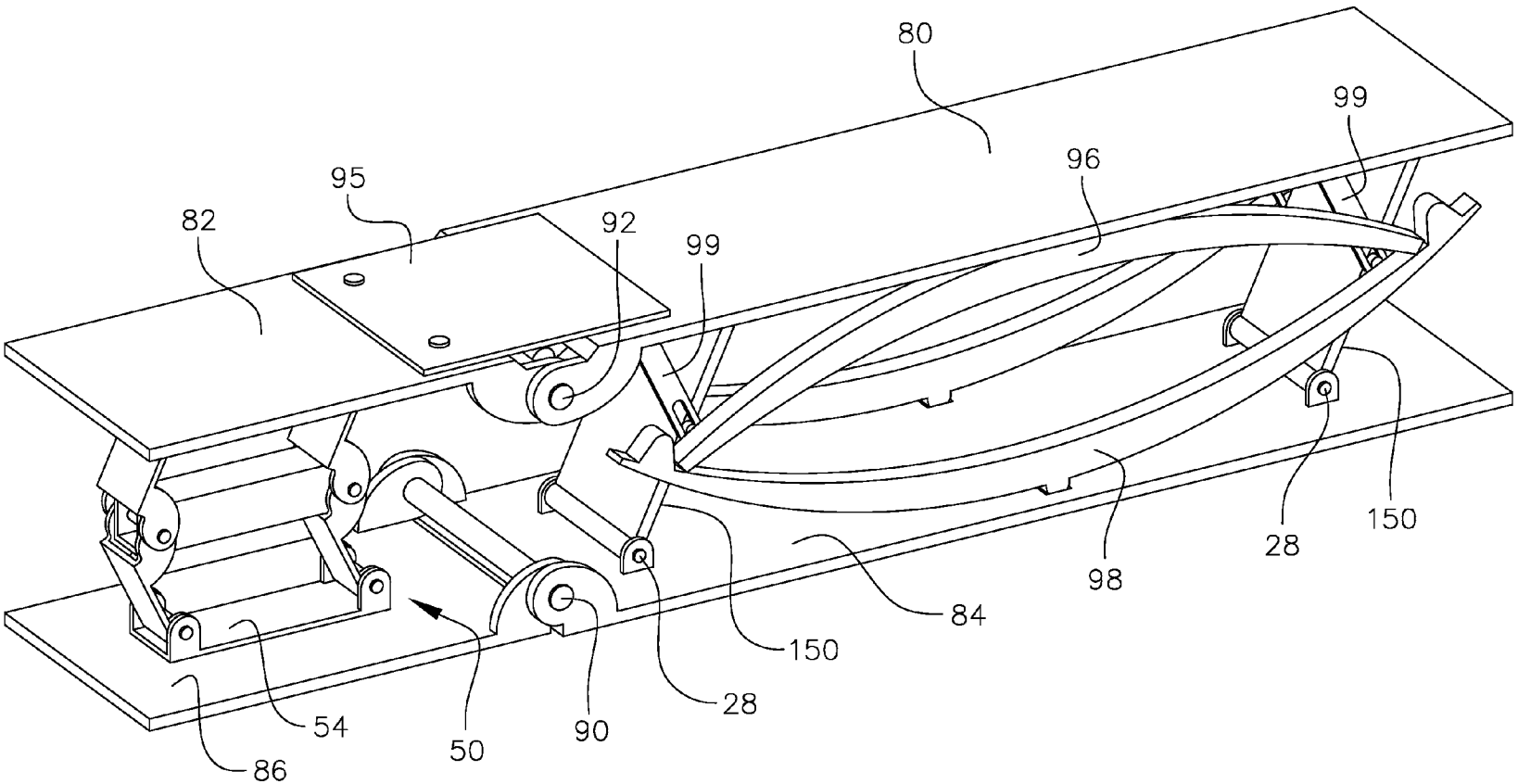
FIG. 16 illustrates an isometric view of a heel suspension mechanism of a second embodiment of the present invention using a leaf spring.

Referring to FIG. 16, an isometric view of a system of a heel suspension mechanism of a second embodiment of the present invention using leaf springs is shown. In this example, a toe suspension mechanism 50 is integrated between the toe support plates 82/86 and heel hinges 150 are integrated between the upper heel support plate 80 and the lower heel support plate 84. The toe suspension mechanism 50 is integrated between the upper toe support plate 82 and the lower toe support plate 86, in that the top surface of the top toe plate 52 is affixed to the bottom surface of the upper toe support plate 82 and bottom surface of the bottom toe plate 54 is affixed to the top surface of the lower toe support plate 86.

The heel hinges 150 are less complicated, hence lower cost, than the heel suspension mechanism 10 of the first embodiment. The heel hinges 150 work differently than the heel suspension mechanisms 10, in that they allow a small amount of backward movement of the upper heel sole 80 with respect to the lower heel sole 84, known as parallel synchronization. Parallel synchronization is similar to horizontal synchronization, except that the top plate is capable of moving back with respect to the top plate whereas in horizontal synchronization, such movement is not allowed. The heel hinges 150 are pivotally interfaced 28 between the upper heel support plate 80 and the lower heel support plate 84. The leaf spring 96/98 pushes the upper heel support plate 80 away from the lower heel support plate 84. In this embodiment, the leaf spring upper portion 98 is biased slightly forward of the lower leaf spring portion 96 so that as the heel hinges 150 are compressed and the upper heel support plate 80 moves slightly backward with respect to the lower heel support plate 84, the upper leaf spring 96 moves to a position where it is slightly biased behind the lower leaf spring 98.

The upper toe support plate 82 is pivotally or bendably coupled to the upper heel support plate 80, in some embodiments by a pivot 92 and the lower toe support plate 86 is pivotally or bendably coupled to the lower heel support plate 84, in some embodiments by a pivot 90. In some embodiments, a flexible interface cover plate 95 prevents the sole of the shoe (not shown) from getting pinched and worn. In some embodiments, a motion limit arm 99 is pivotally coupled between the upper heel support plate 80 and the hinges 150; thereby reducing the possibility of damage to the springs should excessive force be applied.

Figure 16A:
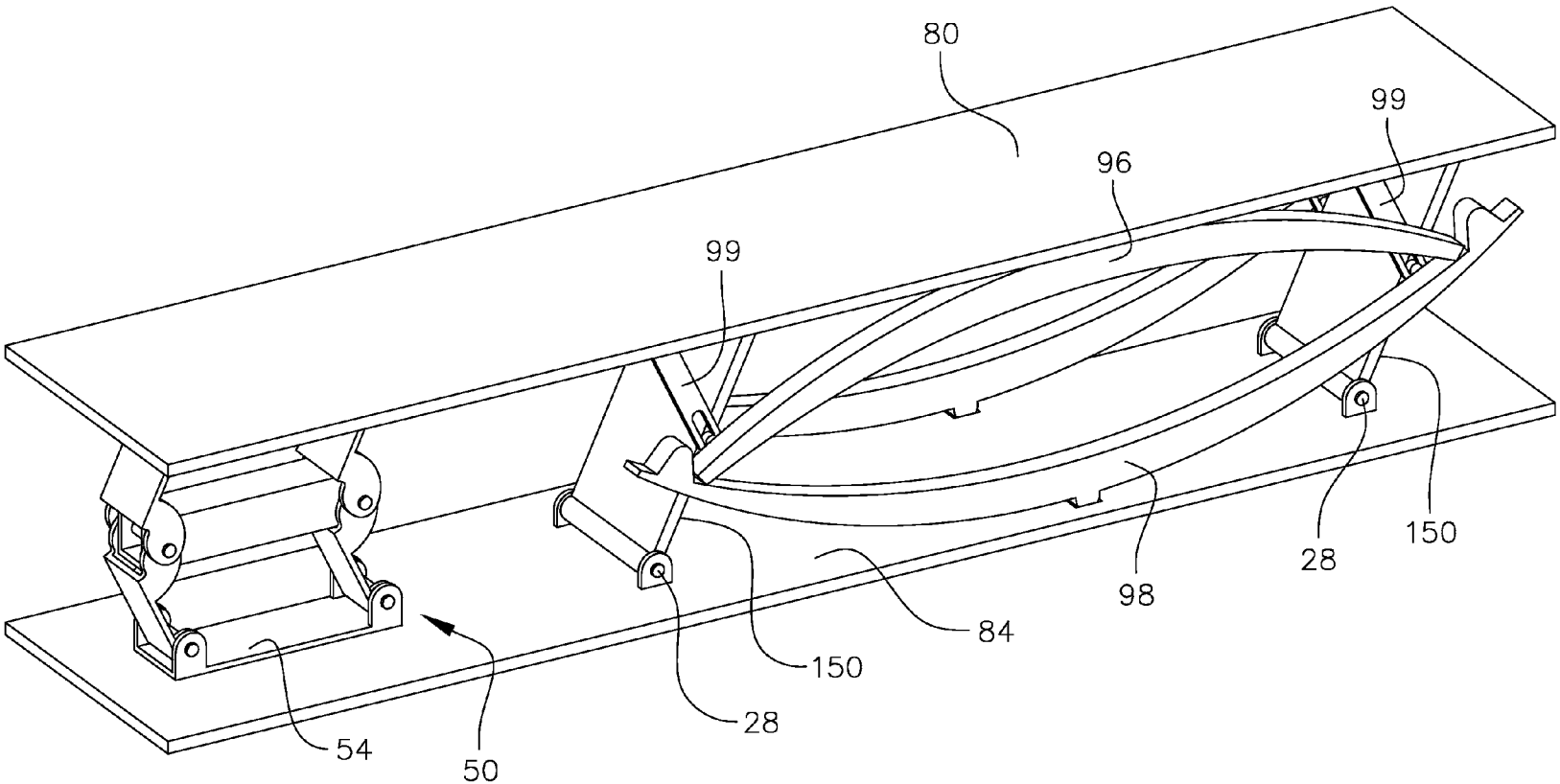
FIG. 16A illustrates an isometric view of a heel suspension mechanism of the present invention using a leaf spring having a monolithic upper and lower sole.

Referring to FIG. 16A, an isometric view of a system of a heel suspension mechanism of the present invention using leaf springs is shown. In this example, a toe suspension mechanism 50 and heel hinges 150 are integrated between the upper support plate 80 and the lower support plate 84. The toe suspension mechanism 50 is integrated between the upper support plate 80 and the lower toe support plate 84, in that the top surface of the top toe plate 52 is affixed to the bottom surface of the upper support plate 80 and bottom surface of the bottom toe plate 54 is affixed to the top surface of the lower support plate 84.

The heel hinges 150 are less complicated, hence lower cost, than the heel suspension mechanism 10 of the first embodiment. As previously described, the heel hinges 150 allow a small amount of backward movement of the upper sole 80 with respect to the lower sole 84. The heel hinges 150 are pivotally interfaced 28 between the upper support plate 80 and the lower support plate 84. The leaf spring 96/98 pushes the upper support plate 80 away from the lower support plate 84. In this embodiment, the leaf spring upper portion 98 is biased slightly forward of the lower leaf spring portion 96 so that as the heel hinges 150 are compressed and the upper support plate 80 moves slightly backward with respect to the lower support plate 84, the upper leaf spring 96 moves to a position where it is slightly biased behind the lower leaf spring 98. In this embodiment, there is only one upper support plate 80 and one lower support plate 84 without a bendable interface as in previous embodiments.

Figure 17:
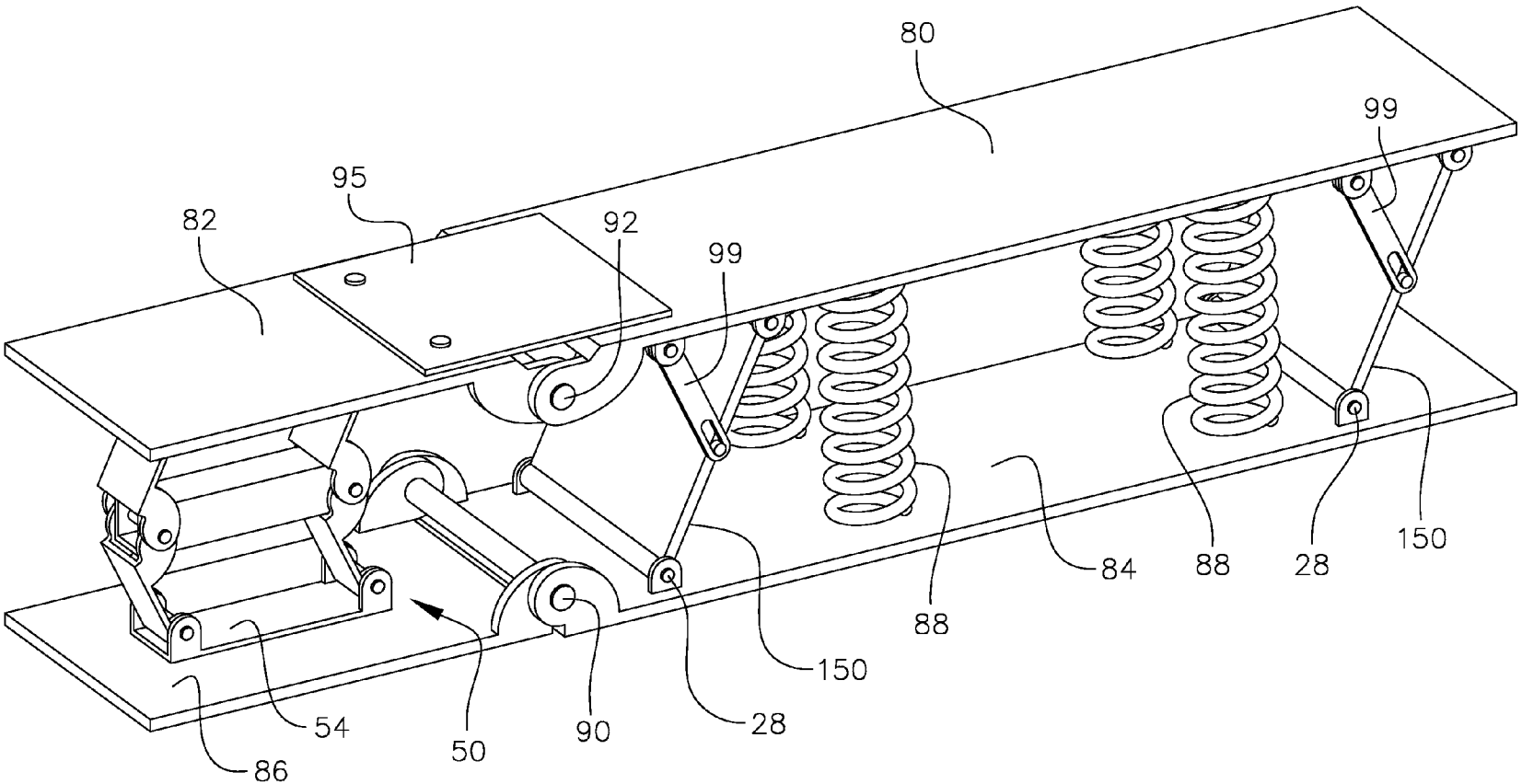
FIG. 17 illustrates an isometric view of a heel suspension mechanism of a second embodiment of the present invention using compression springs.

Referring to FIG. 17, an isometric view of a system of a heel suspension mechanism of a second embodiment of the present invention using compression springs is shown. In this example, a toe suspension mechanism 50 is integrated between the toe support plates 82/86 and heel hinges 150 are integrated between the upper heel support plate 80 and the lower heel support plate 84. The toe suspension mechanism 50 is integrated between the upper toe support plate 82 and the lower toe support plate 86, in that the top surface of the top toe plate 52 is affixed to the bottom surface of the upper toe support plate 82 and bottom surface of the bottom toe plate 54 is affixed to the top surface of the lower toe support plate 86.

The heel hinges 150 are, again, less complicated and, hence, lower cost, than the heel suspension mechanism 10. The heel hinges 150 work differently than the heel suspension mechanisms, in that they allow a small amount of backward movement of the upper heel sole 80 with respect to the lower heel sole 84. The heel hinges 150 are pivotally interfaced 28 between the upper heel support plate 80 and the lower heel support plate 84. The coil spring 88 push the upper heel support plate 80 away from the lower heel support plate 84. In the preferred embodiment, the points at which the coil springs 88 are affixed to the upper heel plate are biased slightly forward of the point where the coil springs 88 are affixed to the bottom heel plate 84 so that as the heel hinges 150 are compressed and the upper heel support plate 80 moves slightly backward with respect to the lower heel support plate 84, the coil springs 88 moves through a perpendicular position to a position where they are slightly biased in the opposite direction.

The upper toe support plate 82 is pivotally or bendably coupled to the upper heel support plate 80, in some embodiments by a pivot 92 and the lower toe support plate 86 is pivotally or bendably coupled to the lower heel support plate 84, in some embodiments by a pivot 90. In some embodiments, a flexible interface cover plate 95 prevents the sole of the shoe (not shown) from getting pinched and worn. In some embodiments, a motion limit arm 99 is pivotally coupled between the upper heel support plate 80 and the hinges 150; thereby reducing the possibility of damage to the springs should excessive force be applied.

Figure 18:
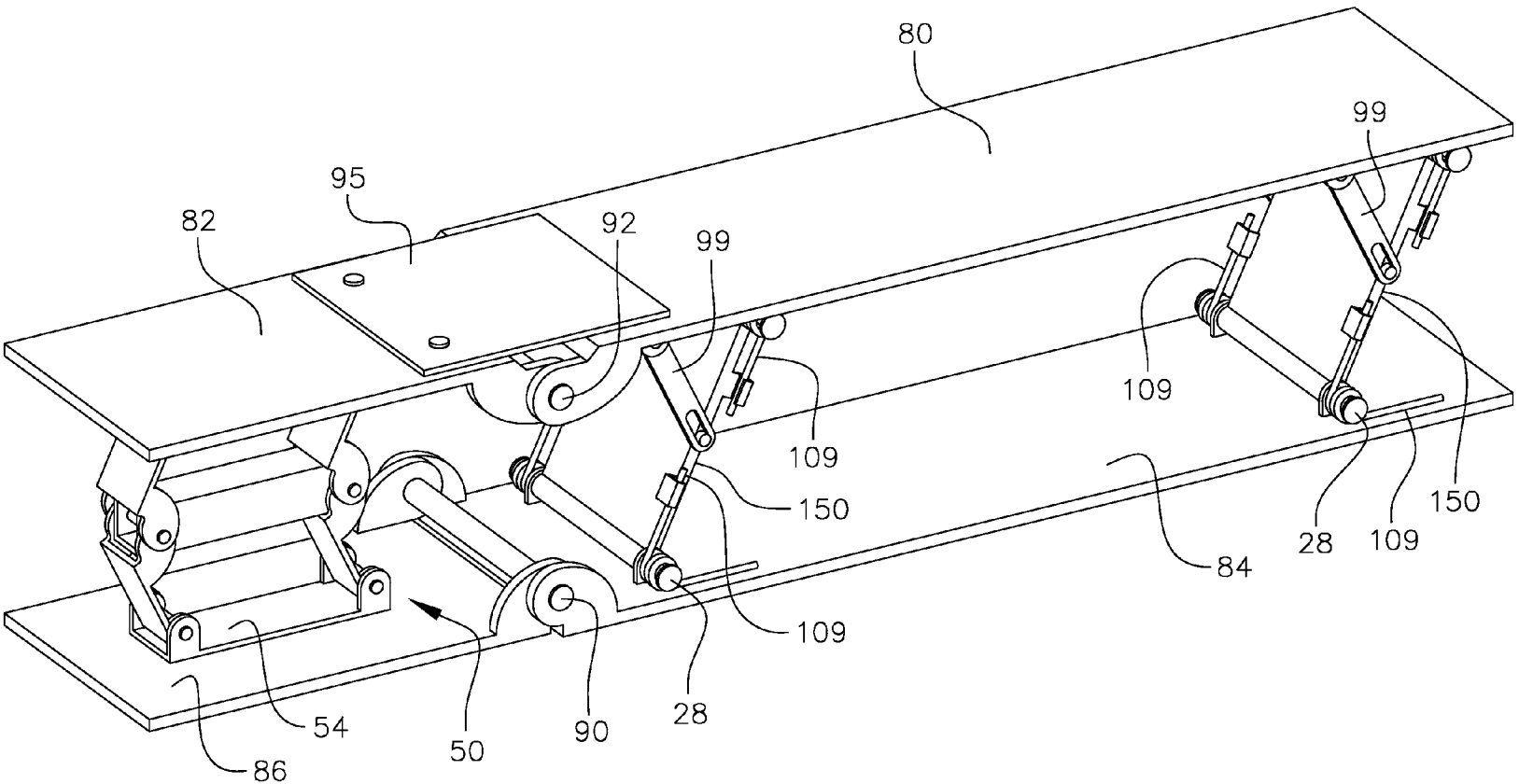
FIG. 18 illustrates an isometric view of a heel suspension mechanism of a second embodiment of the present invention using torsion springs.

Referring to FIG. 18, an isometric view of a system of a heel energy-return system of a second embodiment of the present invention using torsion springs is shown. In this example, a toe suspension mechanism 50 is integrated between the toe support plates 82/86 and heel hinges 150 are integrated between the upper heel support plate 80 and the lower heel support plate 84. The toe suspension mechanism 50 is integrated between the upper toe support plate 82 and the lower toe support plate 86, in that the top surface of the top toe plate 52 is affixed to the bottom surface of the upper toe support plate 82 and bottom surface of the bottom toe plate 54 is affixed to the top surface of the lower toe support plate 86.

The heel hinges 150 are less complicated, hence lower cost, than the heel suspension mechanism 10. Again, the heel hinges 150 work differently than the heel suspension mechanisms of the first embodiment; in that they allow a small amount of backward movement of the upper heel sole 80 with respect to the lower heel sole 84. The heel hinges 150 are pivotally interfaced 28 between the upper heel support plate 80 and the lower heel support plate 84. In this embodiment, the torsion springs 109 urge the hinges 150 toward an open position.

The upper toe support plate 82 is pivotally or bendably coupled to the upper heel support plate 80, in some embodiments by a pivot 92 and the lower toe support plate 86 is pivotally or bendably coupled to the lower heel support plate 84, in some embodiments by a pivot 90. In some embodiments, a flexible interface cover plate 95 prevents the sole of the shoe (not shown) from getting pinched and worn. In some embodiments, a motion limit arm 99 is pivotally coupled between the upper heel support plate 80 and the hinges 150; thereby reducing the possibility of damage to the springs should excessive force be applied.

Figure 19:
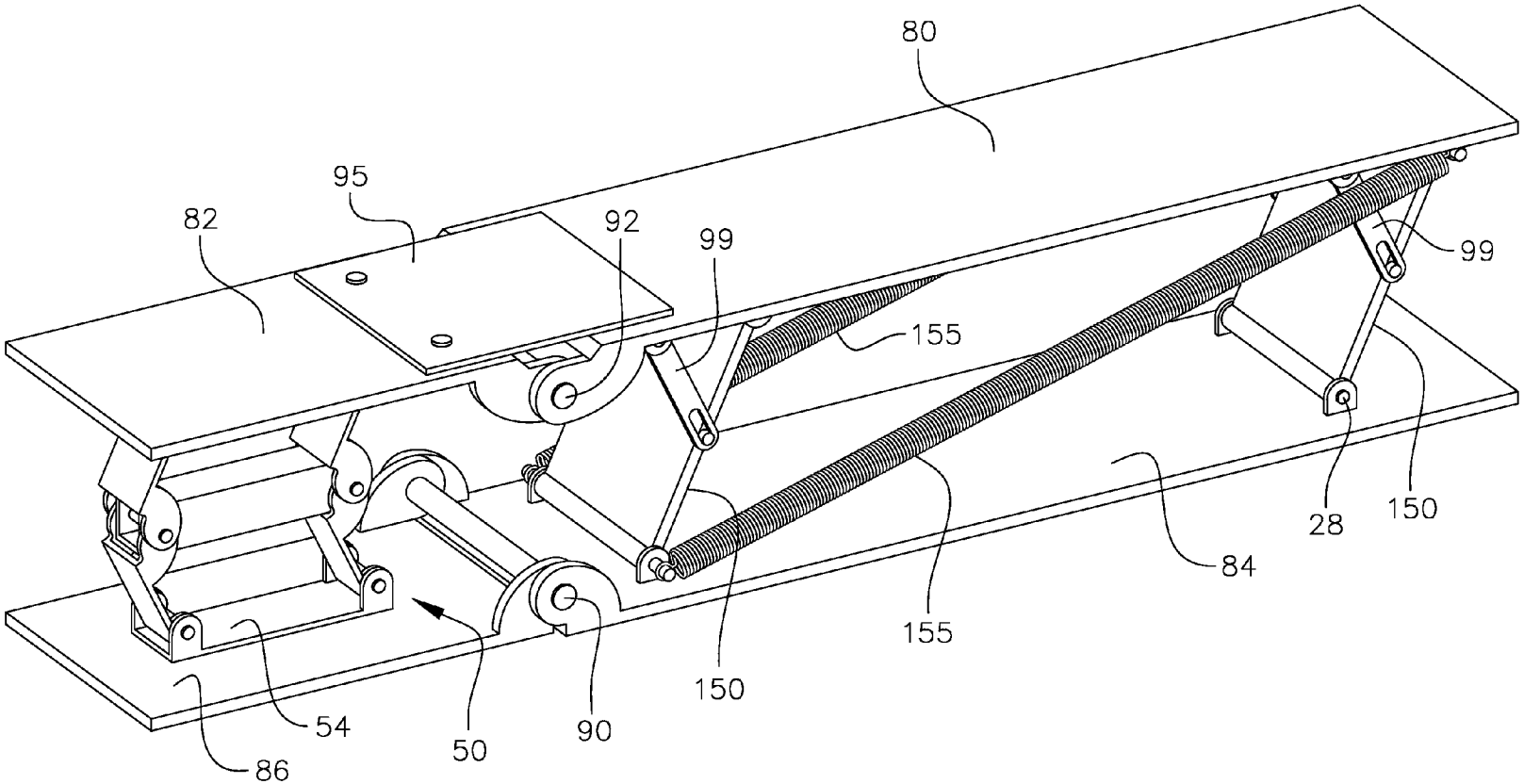
FIG. 19 illustrates an isometric view of a heel suspension mechanism of a second embodiment of the present invention using expansion springs.

Referring to FIG. 19, an isometric view of a heel energy-return system of a second embodiment of the present invention using expansion springs is shown. In this example, a toe suspension mechanism 50 is integrated between the toe support plates 82/86 and heel hinges 150 are integrated between the upper heel support plate 80 and the lower heel support plate 84. The toe suspension mechanism 50 is integrated between the upper toe support plate 82 and the lower toe support plate 86, in that the top surface of the top toe plate 52 is affixed to the bottom surface of the upper toe support plate 82 and bottom surface of the bottom toe plate 54 is affixed to the top surface of the lower toe support plate 86.

The heel hinges 150 are less complicated and, hence, lower in cost than the heel suspension mechanism 10. Again, the heel hinges 150 work differently than the heel suspension mechanisms; in that they allow a small amount of backward movement of the upper heel sole 80 with respect to the lower heel sole 84. The heel hinges 150 are pivotally interfaced 28 between the upper heel support plate 80 and the lower heel support plate 84. Expansion springs 155 urge the upper heel support plate 80 forward with respect to the lower heel support plate 84.

The upper toe support plate 82 is pivotally or bendably coupled to the upper heel support plate 80, in some embodiments by a pivot 92 and the lower toe support plate 86 is pivotally or bendably coupled to the lower heel support plate 84, in some embodiments by a pivot 90. In some embodiments, a flexible interface cover plate 95 prevents the sole of the shoe (not shown) from getting pinched and worn. The coil spring 88 push the upper heel support plate 80 away from the lower heel support plate 84. In some embodiments, a motion limit arm 99 is pivotally coupled between the upper heel support plate 80 and the hinges 150; thereby reducing the possibility of damage to the springs should excessive force be applied.

Figure 20:
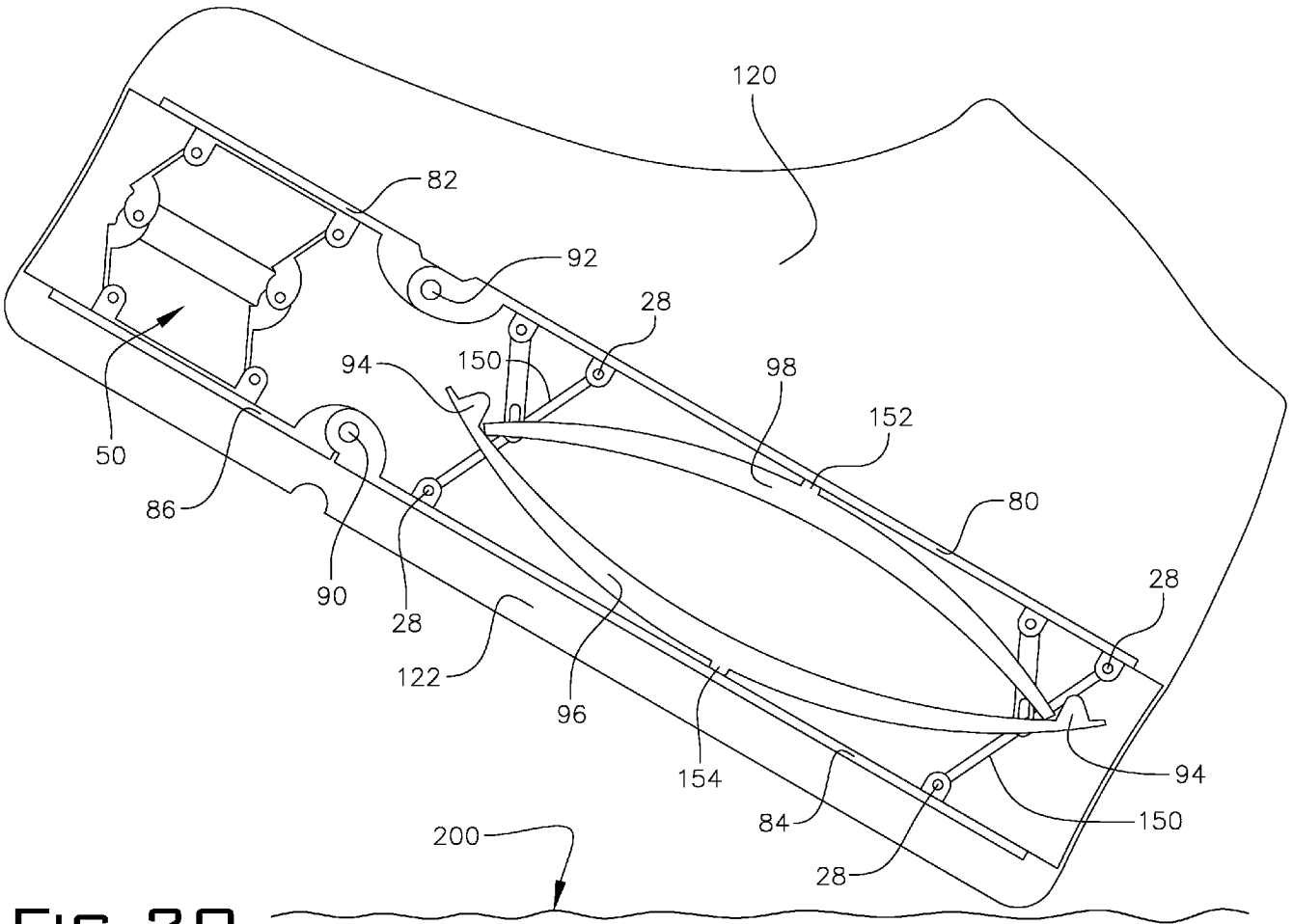
FIG. 20 illustrates an isometric view of a system with a heel suspension mechanism of a second embodiment of the present invention using a leaf spring before a step.
Figure 21:
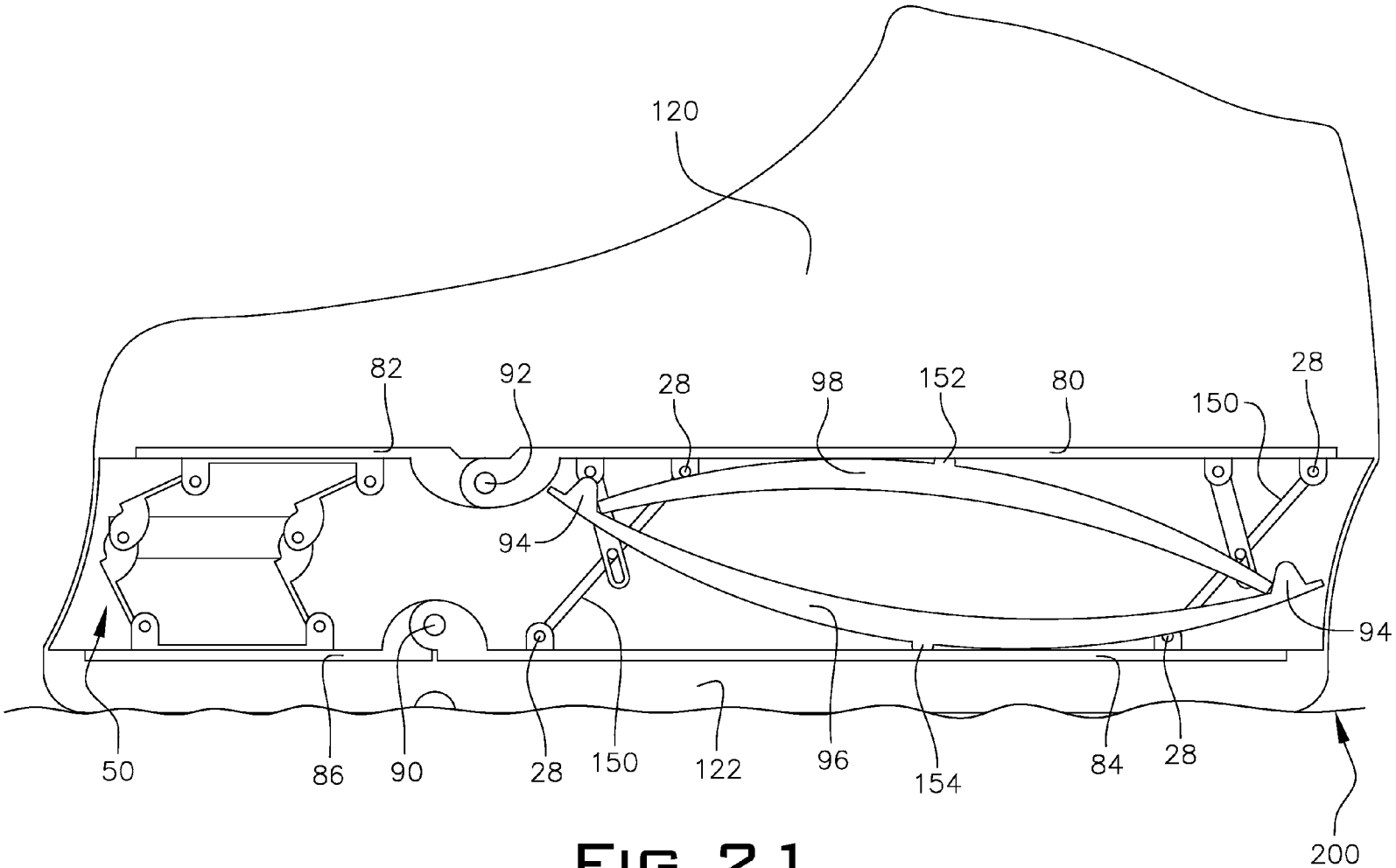
FIG. 21 illustrates an isometric view of a system with a heel suspension mechanism of a second embodiment of the present invention using a leaf spring during a step.
Figure 22:
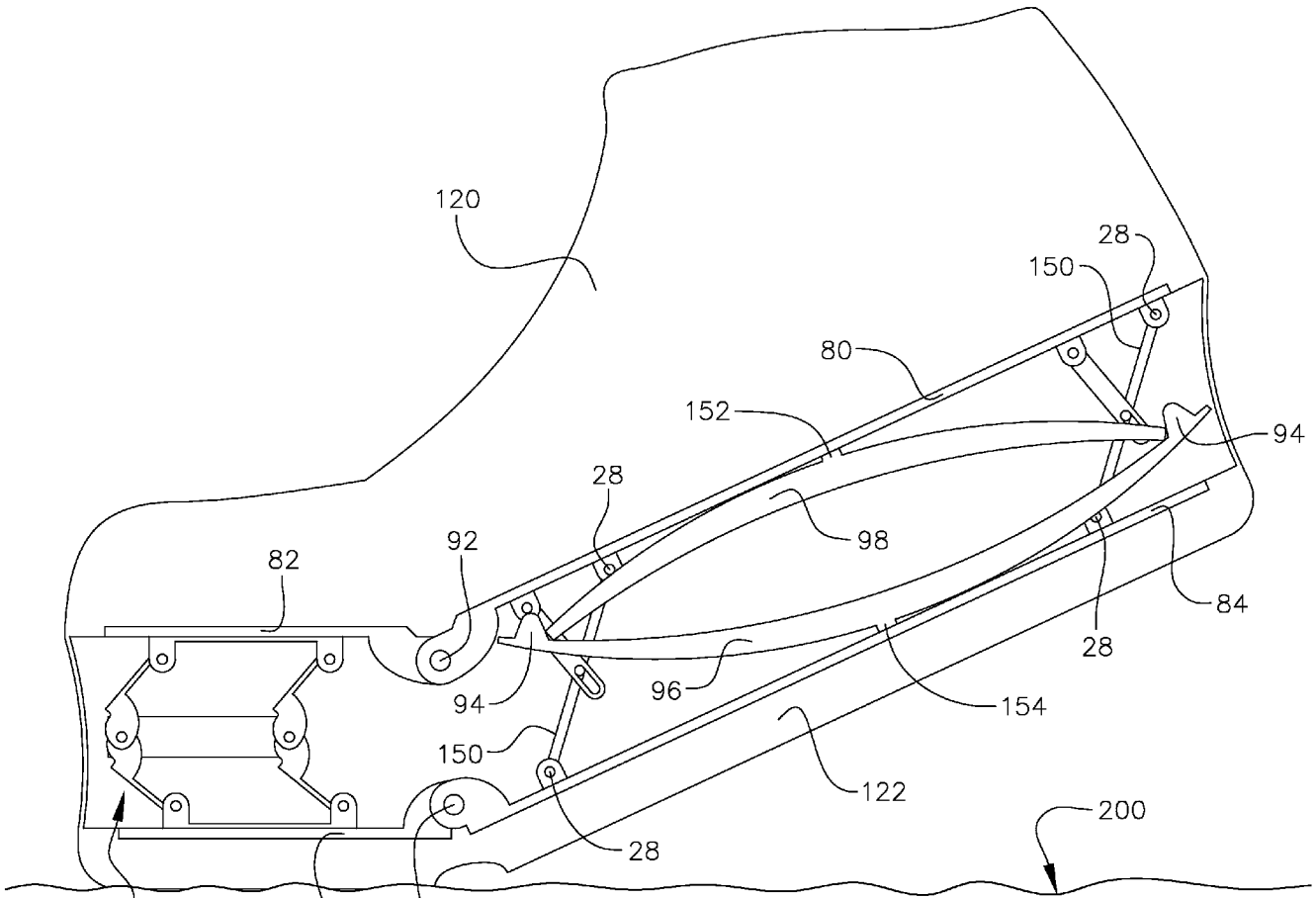
FIG. 22 illustrates an isometric view of a system with a heel suspension mechanism of a second embodiment of the present invention using a leaf spring during push off.
Figure 22A:
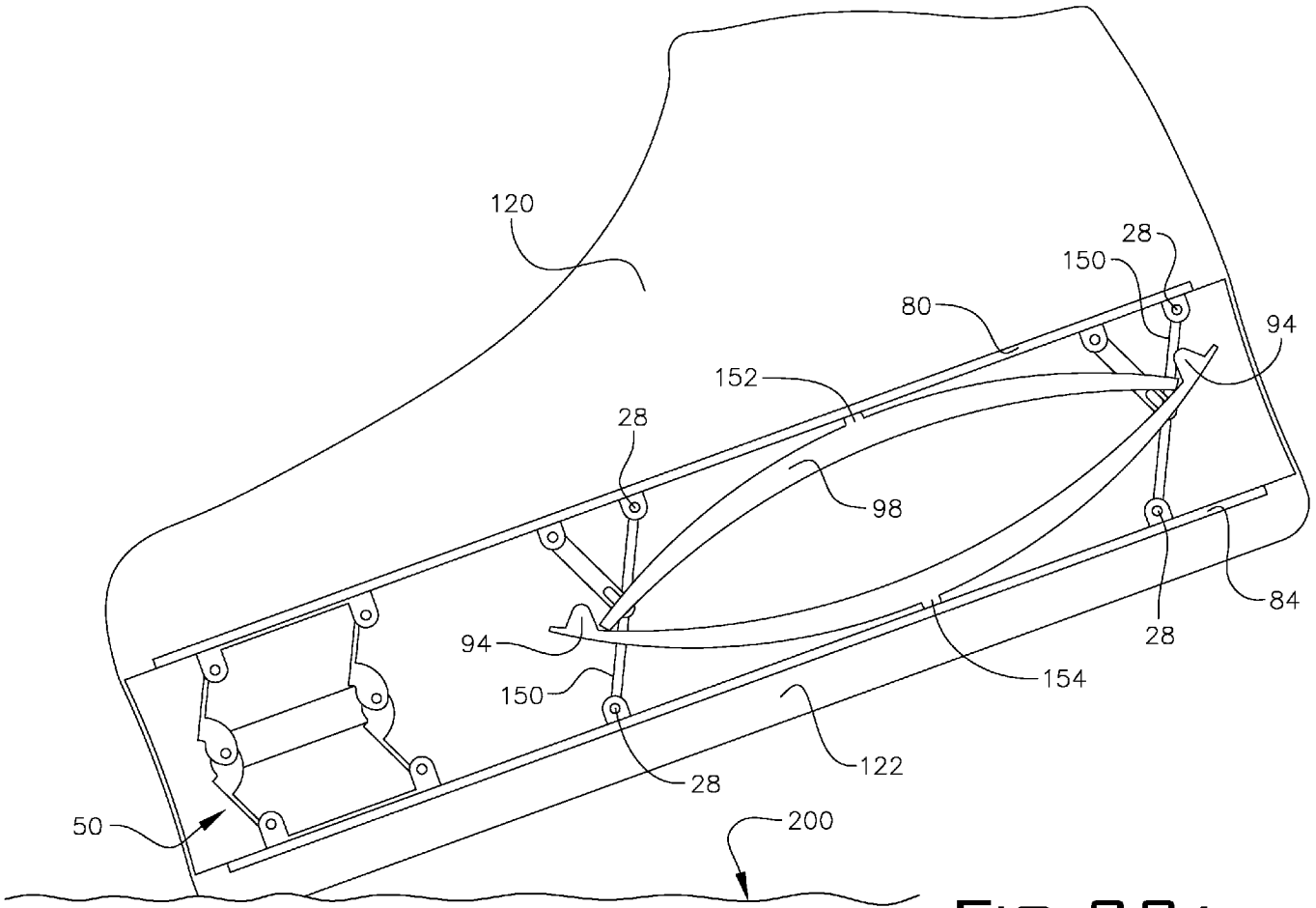
FIG. 22A illustrates an isometric view of a system with a heel suspension mechanism using a leaf spring during push off with a monolithic upper sole plate.

Referring to FIGS. 20 through 22, an isometric view of a heel energy-return system of a second embodiment of the present invention using a leaf spring before the shoe with the energy-return system is placed on the ground is shown. Although the embodiment with a leaf spring is shown, FIGS. 20-22 show the operation of the hinge mechanisms and operate in a similar fashion with all known types of springs. In FIG. 20, the heel of the shoe is about to meet the ground 200. Since no pressure is yet to be placed upon the heel or sole of the shoe 120, the hinges 50/150 are in their open position, in that the leaf spring 96/98 exerts force between the upper heel plate 80 and the lower heel plate 84, thereby holding the upper heel plate 80 and lower heel plate 84 at their maximum separation. Note that the leaf spring 96/98 is now slightly biased so its top attachment point 152 is now further towards the front of the shoe-part 120 than its bottom attachment point 154. In FIG. 21, the heel is firmly planted on the ground 200 and the leaf spring 98/96 is compressed by the weight of the user (not shown). Note that the leaf spring 96/98 is now back-biased so its top attachment point 152 is now further towards the back of the shoe-part 120 than its bottom attachment point 154. In some embodiments, the leaf spring is a monolithic leaf spring. In the embodiment shown, the leaf spring 96/98 comprises two unbonded half leaf springs 96/98 held in relationship with each other by protrusions 94 on one of the leaf springs 96/98. This unbonded relationship between two halves of the leaf springs 96/98 permits pivoting at the contact point as the springs 96/98 compress, thereby increasing the life of the springs 96/98. In FIGS. 22 and 22A, the wearer is starting to lift his or her foot and is being partially propelled or boosted by the release forces of the spring 96/98. FIG. 22A is shown without pivots between the upper toe and upper heel and between the lower toe and lower heel.

Figure 23:
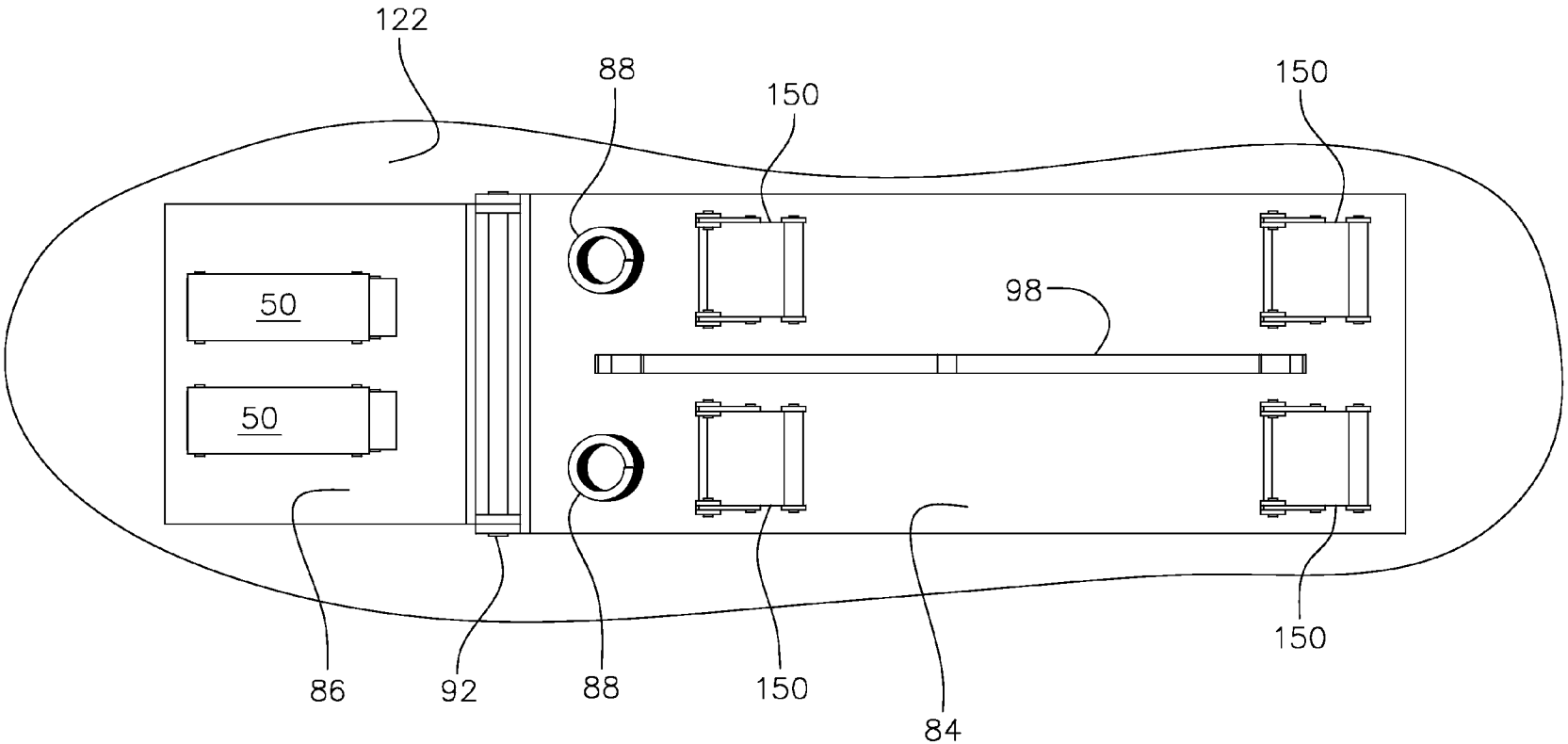
FIG. 23 illustrates a schematic plan view of a typical configuration of the suspension mechanisms of the second embodiment of the present invention.

Referring to FIG. 23, a schematic view of a typical configuration of the energy-return system of the second embodiment of the present invention is shown. Looking from the top, in this example, two toe suspensions 50 are affixed to the lower toe plate 86. Four heel hinges 150 are affixed to the lower heel plate 84. Although previously shown utilizing only a single spring type in the previous examples, the example of FIG. 23 has two different types of springs; coil springs 88 and a leaf spring 96. It is envisioned that in various embodiments, any single spring type or combination of spring types is used. Being that different spring types have different force compression and expansion curves, by using multiple spring types, the combined force curves provide differing action.

Also shown in FIG. 23 is a sole 122 affixed to the bottom surface of the lower toe plate 86 and lower heel plate 84. In a preferred embodiment, the sole 122 is wider and longer than the combined lower toe plate 86 and lower heel plate 84, providing for a small amount of bending when the wearer's foot interfaces with the ground 200 at an angle.

Figure 24:
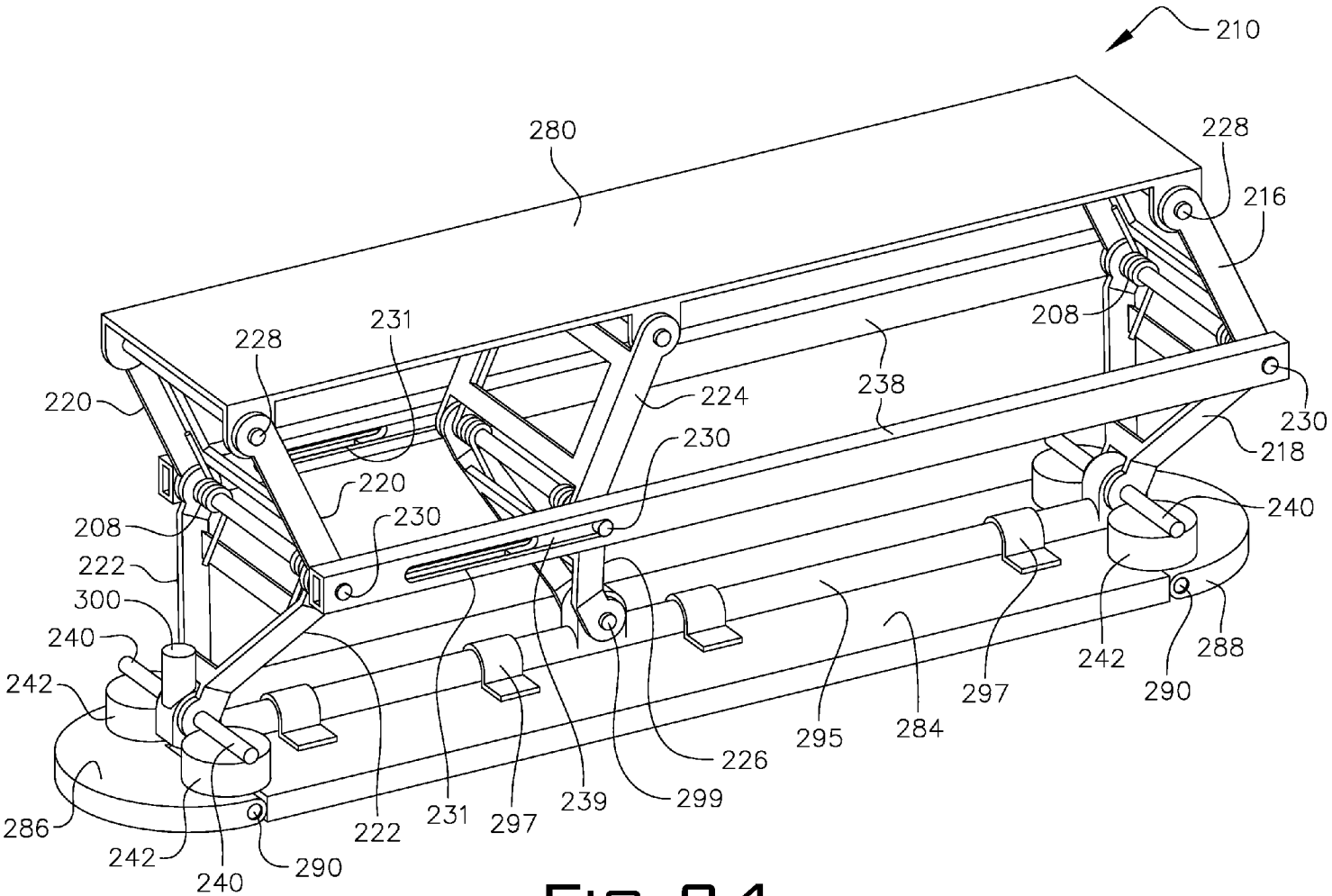
FIG. 24 illustrates an isometric view of a heel suspension mechanism of a third embodiment of the present invention.

Referring to FIG. 24, an isometric view of an energy-return system of a third embodiment of the present invention is shown. The suspension system 210 of this embodiment resembles the heel suspension mechanism 10 of the first embodiment. The suspension system 210 has at least two forward facing hinges 220/222/216/218 and at least one backward facing hinge 224/226. A first end of each hinge is pivotally connected to an upper plate 280 by pivots 228. A second end of each hinge is pivotally affixed to a shaft 295 by pivots 240/299. The shaft 295 is affixed to a lower plate 284 by brackets 297, allowing the shaft 295 to turn within the brackets. Extended pivots 240 resting on bumpers 242 controls the travel radius of turning of the shaft 295 within the brackets 297. The bumpers 242 are preferably made from a spring-like rubber material that deforms under pressure and restores after the pressure abates. In some embodiments a toe 286 and/or heel plate 288 are pivotally connected to the heel plate 284 by pivots 290. In such embodiments, the toe plate 286 and/or heel plate 288 bend when the wearer rests on his or her toe/heel. In these embodiments, the bumpers 242 restrict the amount of bending of the toe plate 286 and/or heel plate 288.

In some embodiments, one or more motion limiters 300 are provided to prevent the hinges 220/222/216/218/224/226 from closing too far.

To maintain the upper plate 280, parallel with the lower plate 284, the forward facing hinges 220/222/216/218 are linked at their pivots 230 by a rigid connecting rod 238. The pivots 230 of the backward facing hinges 224/226 are affixed to an inner shaft 239 which is coupled to the connecting rod 238. The pivot 230 slidably travels in slots 231 in the rigid connecting rod 238 so that all hinge pivots 230 are maintained in a horizontal plane, thereby locking the upper plate 280 in horizontal synchronization with the lower plate 284. In other words, the upper plate 280 is movable toward and away from the lower plate 284, but the upper plate 280 is restricted from moving forward or backward with respect to the lower plate 284, reducing the feeling of walking on ice which would occur without such linkages. The length of slot 231 is sized to permit closure of the hinges 220/222/216/218/224/226 to the desired amount of closure, whereby the pivot pin 230 of the forward facing hinge 224/226 reaches the forward end of the slot 231 before the hinges 220/222/216/218/224/226 completely close. Likewise, the slot 231 is sized to limit the amount of opening of the hinges 220/222/216/218/224/226 to a desired amount, whereby the pivot pin 230 of the forward hinge 224/226 reaches the back end of the slot 231 as the hinges 220/222/216/218/224/226 open to the desired degree. It is envisioned that in alternate embodiments the rigid connecting rod 238 be made such that the pivot pin 230 slides in slot 231 without the use of the inner shaft 239. The hinges 220/222/216/218/224/226 are urged open by springs; in this example torsion springs 208. In other embodiments, different types of springs are used.

Figure 25:
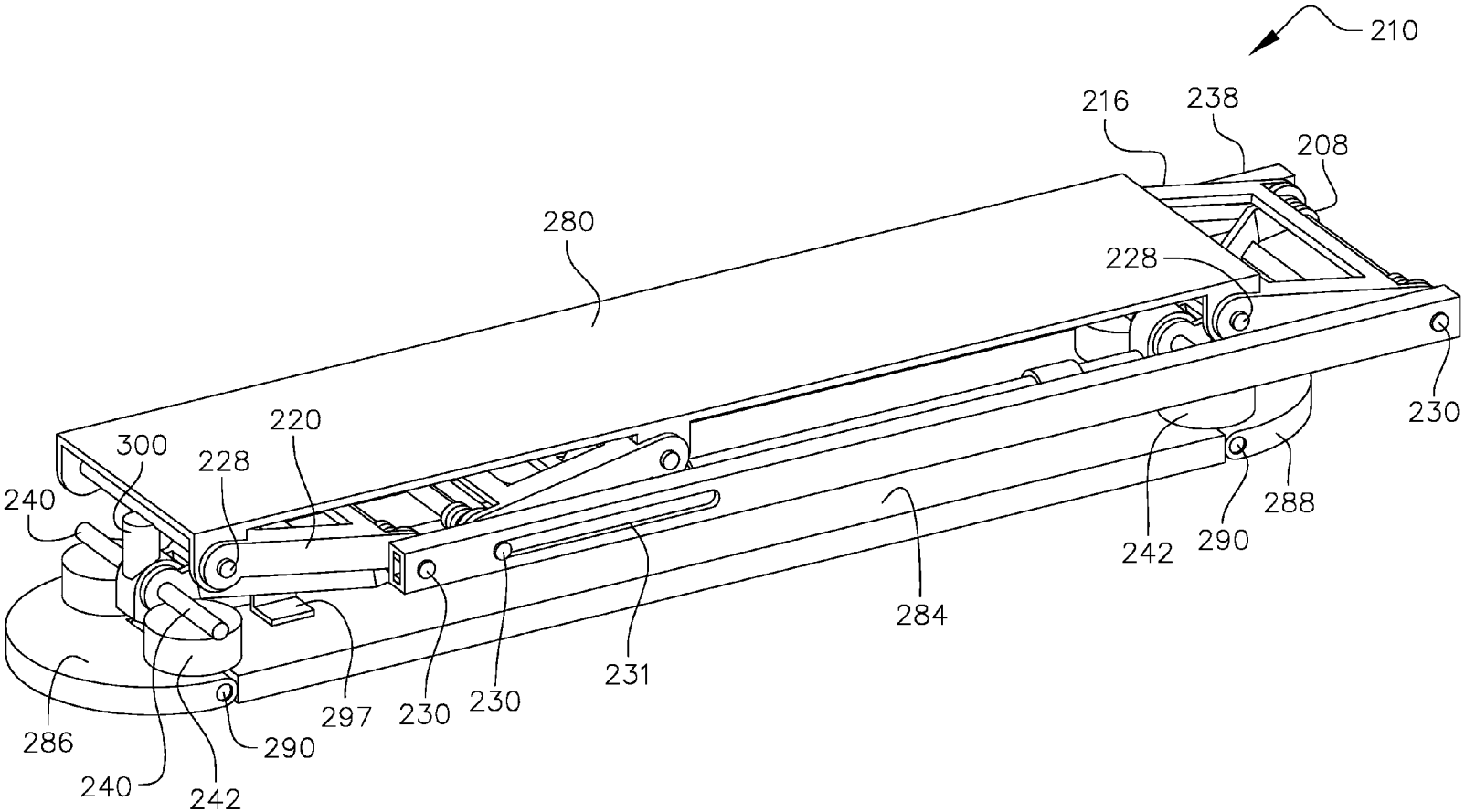
FIG. 25 illustrates an isometric view of a heel suspension mechanism of a third embodiment of the present invention in a compressed mode.

Referring to FIG. 25, an isometric view of an energy-return system of a third embodiment of the present invention in a compressed mode is shown. In this view, the pivot pin 230 has traveled to the forward end of the slot 231 before the hinges 220/222/216/218/224/226 completely close; therefore, the hinges 220/222/216/218/224/226 are closed as far as they can close.

Figure 26:
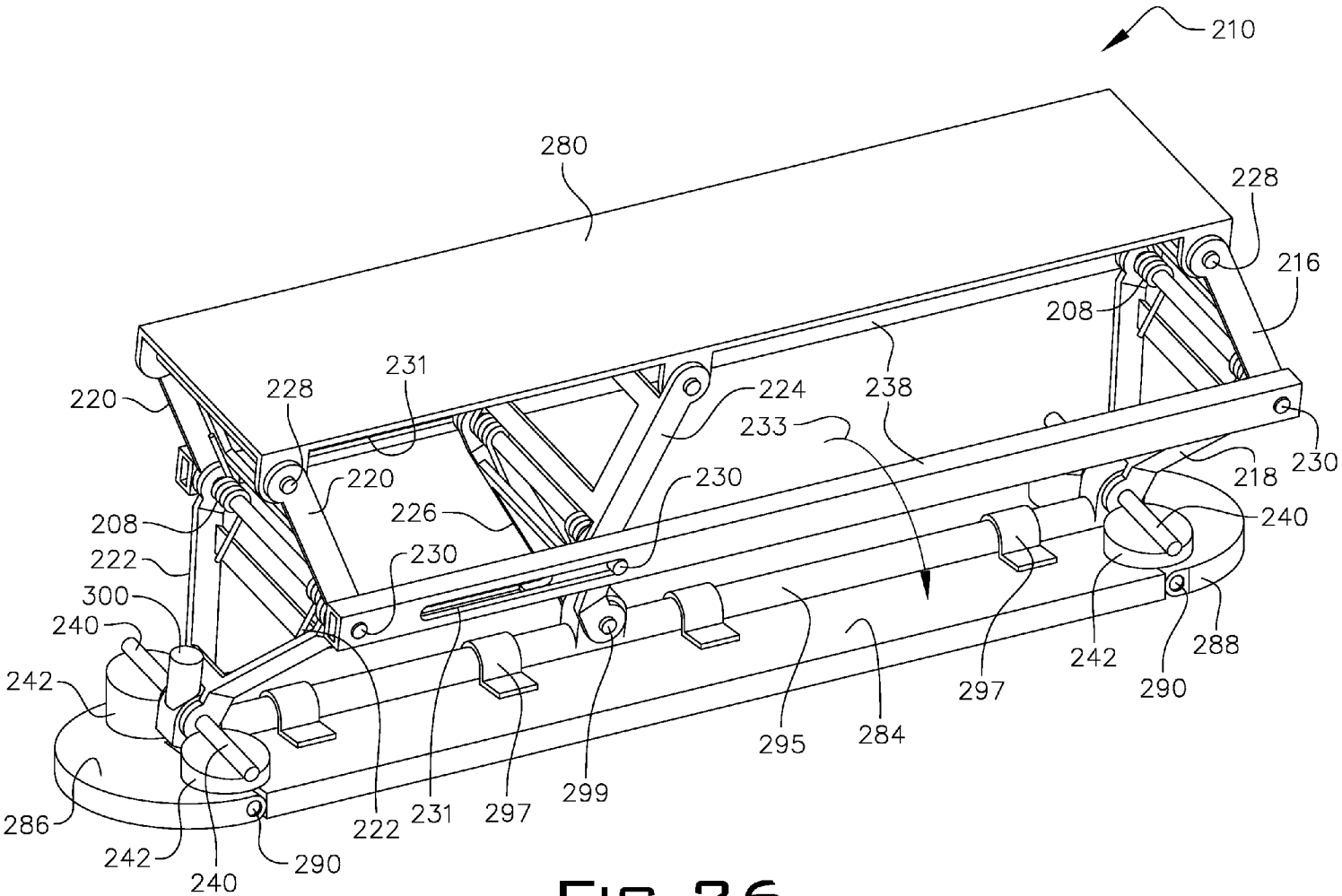
FIG. 26 illustrates an isometric view of a system using a heel suspension mechanism of a third embodiment of the present invention showing a shift of force of the wearer.

Referring to FIG. 26, an isometric view of an energy-return system of a third embodiment of the present invention showing a shift of force of the wearer is shown. In this view, the wearer has shifted his or her weight to the left 233, thereby placing more force on the left side (the side closest to the viewer) of the mechanism 210. In response, the hinges 220/222/216/218/224/226 are skewed to the left along the shaft 295, causing the shaft 295 to rotate to the left within the brackets 297, thereby the pivot pins 240 placing more force on the left bumpers 242 (front) than the right bumpers 242 (back), deforming the left bumpers 242. When the force is released (e.g., the wearer restores side-to-side balance), the left bumpers 242 restore to their original size/shape.

Figure 27:
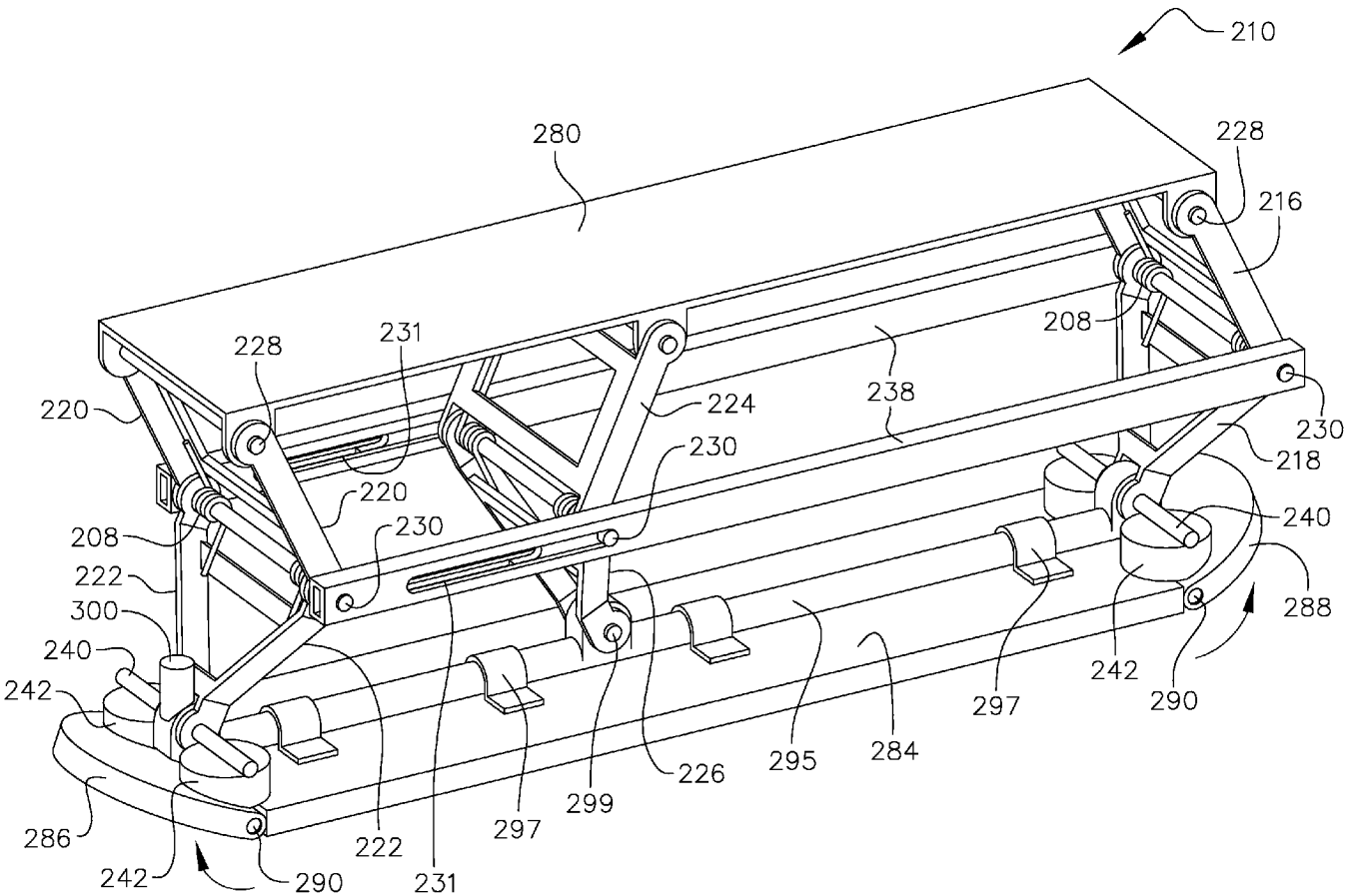
FIG. 27 illustrates an isometric view of a system using a heel suspension mechanism of a third embodiment of the present invention showing a toe bend and a heel bend.

Referring to FIG. 27, an isometric view of an energy-return system of a third embodiment of the present invention showing a toe bend and a heel bend. This view shows what happens when the user rests upon their toe or heel (the view shows both bent at the same time, even though this is difficult to achieve). As the wearer places extra force on the toe or heel, the toe plate 286 or heel plate 288 bends along the toe/heel plate pivots 290. As the toe plate 286 or heel plate 288 lifts, force is applied to the bumpers 242. The bumpers 242 deform in response to the force. When the force abates, the toe/heel plates 286/288 restore to their original position with the help of the resiliency of the bumpers 242. It is envisioned that in other embodiments, the bumpers 242 are of differing shapes and, in some embodiments, combined.

Figure 28:
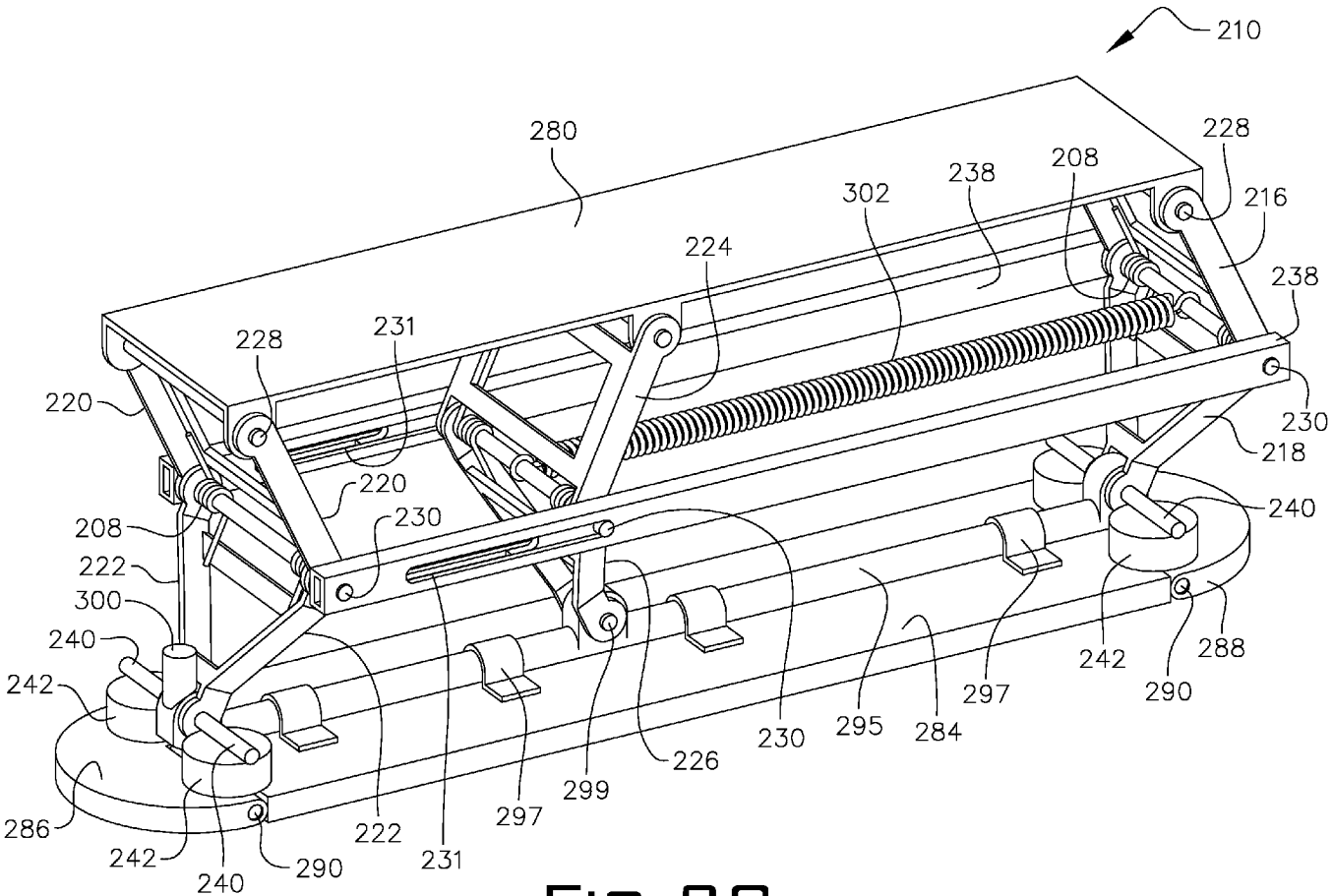
FIG. 28 illustrates an isometric view of a system using a heel suspension mechanism of a third embodiment of the present invention using both torsion and extension springs.

Referring to FIG. 28, an isometric view of an energy-return system of a third embodiment of the present invention using both torsion and extension springs is shown. This embodiment operates as in FIGS. 24-27 with the addition of an extension spring 302. In other embodiments, other types of springs are used in conjunction with the torsion springs 208 or in place of the torsion springs 208. As stated before, different types of springs have different force curves and in different applications of the present invention, combined force curves are advantageous.

Figure 29:
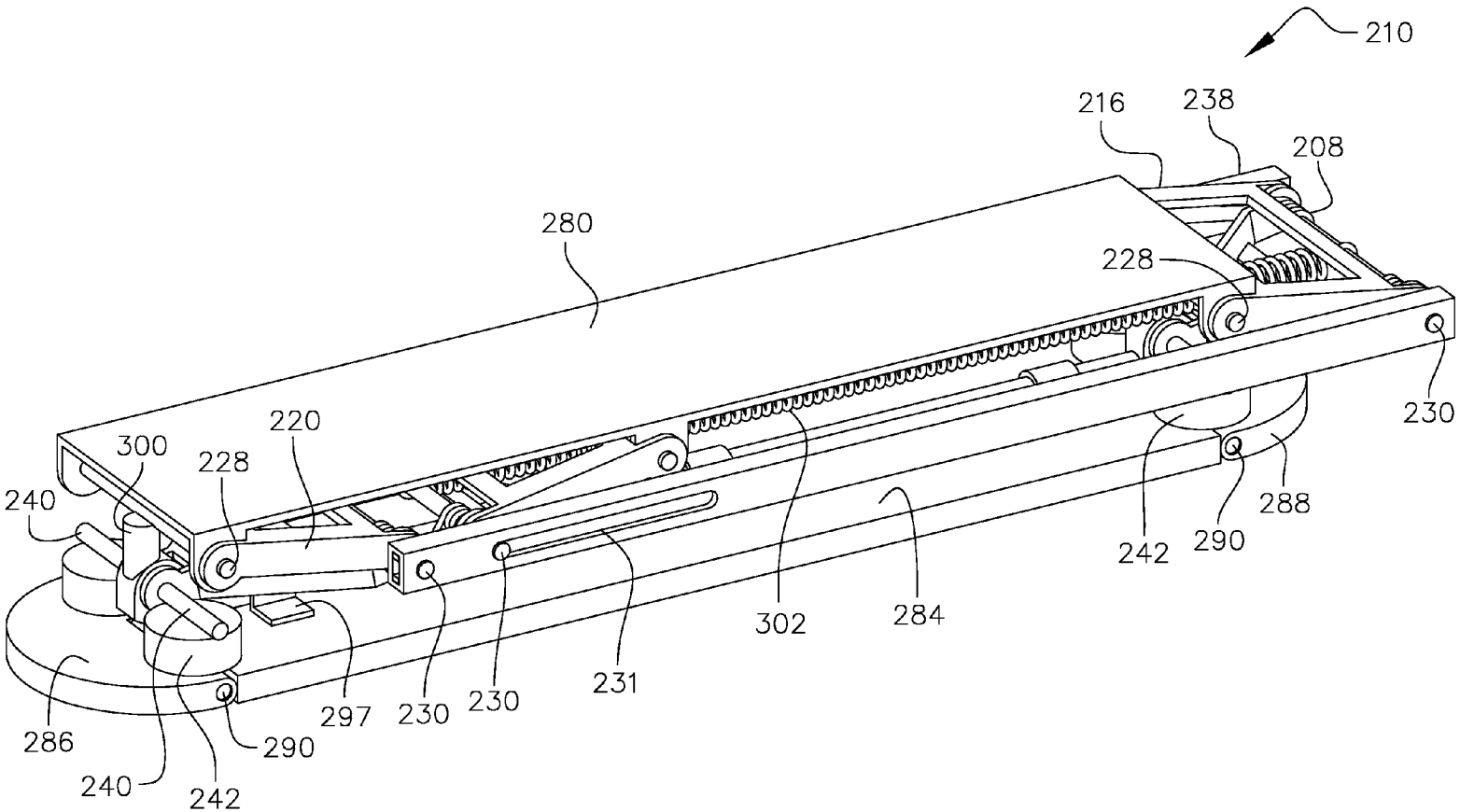
FIG. 29 illustrates an isometric view of a system using a heel suspension mechanism of a third embodiment of the present invention using both torsion and extension springs in a compressed mode.

Referring to FIG. 29 illustrates an isometric view of an energy-return system of a third embodiment of the present invention using both torsion and extension springs in a compressed mode is shown. Again, this embodiment operates as in FIGS. 24-27 with the addition of an expansion spring 302.

Figure 30:
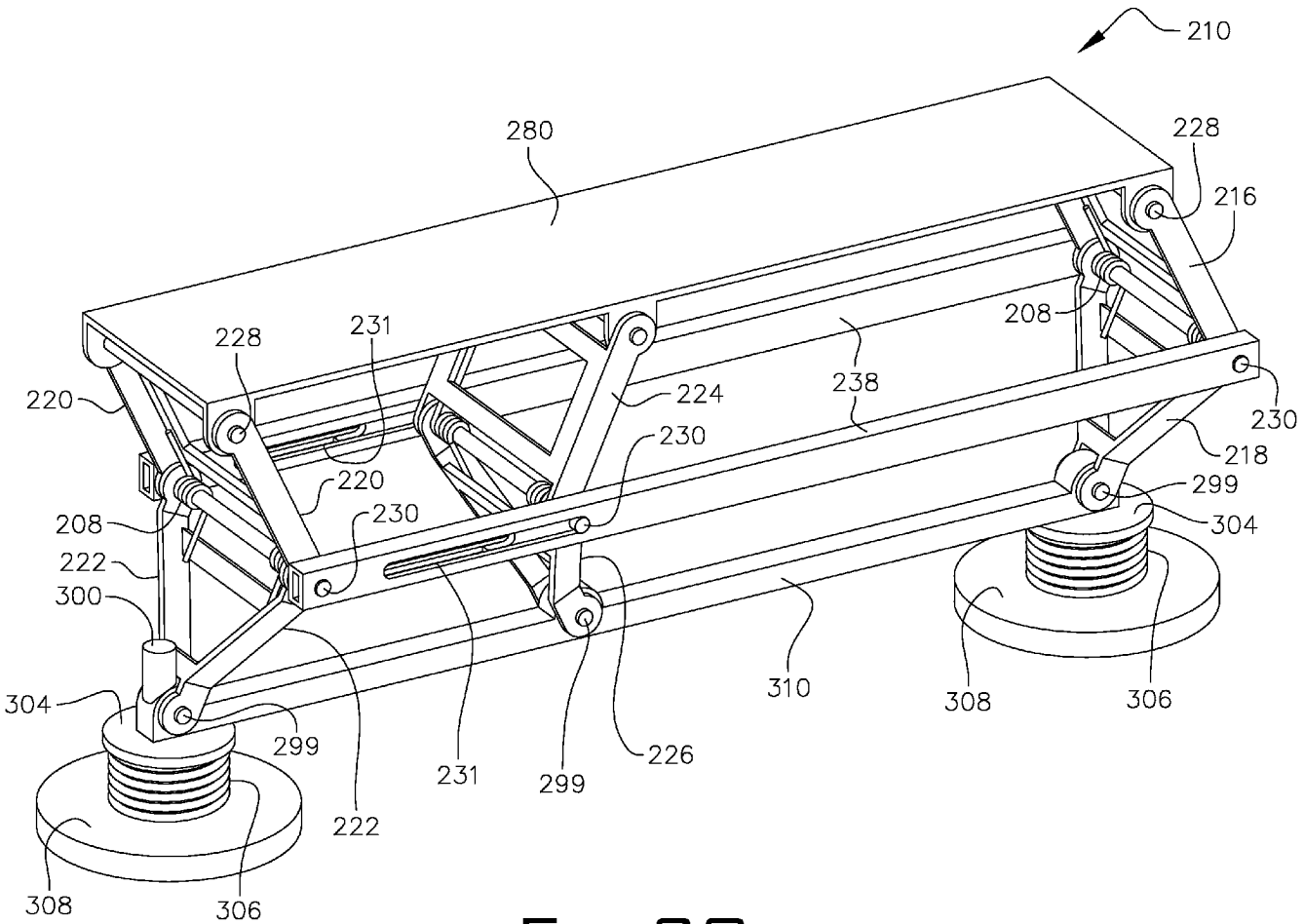
FIG. 30 illustrates an isometric view of a system using a heel suspension mechanism of a third embodiment of the present invention using torsion springs with cushioned contact points.

Referring to FIG. 30, an isometric view of an energy-return system of a third embodiment of the present invention using torsion springs with 360 degree pivoting contact points is shown. The system of FIG. 30 is similar and operates like the suspension mechanism of FIGS. 24-29 with the addition of 360 degree pivoting contact points 308. The 360 degree pivoting contact points 308 are affixed to a ball and socket joint attached to the end of a bar 310. Note, since the 360 degree pivoting contact points provide for lateral rotation, it is not necessary to provide a rotatable bar 295 as in FIGS. 24-29. The 360 degree pivoting contact point 308 is pivotally mounted to the bar 310 by a ball joint (not visible) and biased evenly by a coil spring 306 such that in absence of external force, the 360 degree pivoting contact point 308 is substantially parallel to the spring retention washer 304 and the bar 310. As lateral or forward/backward force is applied to one edge of the cushion contact point 308, that side of the cushioned contact point 308 presses against the biasing spring 306, deforming that side of the biasing spring 306, thereby providing traction and maneuverability. In some embodiments, a motion limiter 300 is provided to limit the amount of closure of the suspension system 210. It is preferred that the motion limiter 300 be made of a resilient rubber or similar material that absorbs some of the shock when the suspension system 210 closes. In some embodiments, multiple motion limiters 300 are situated at different locations within the suspension system 210.

Figure 31:
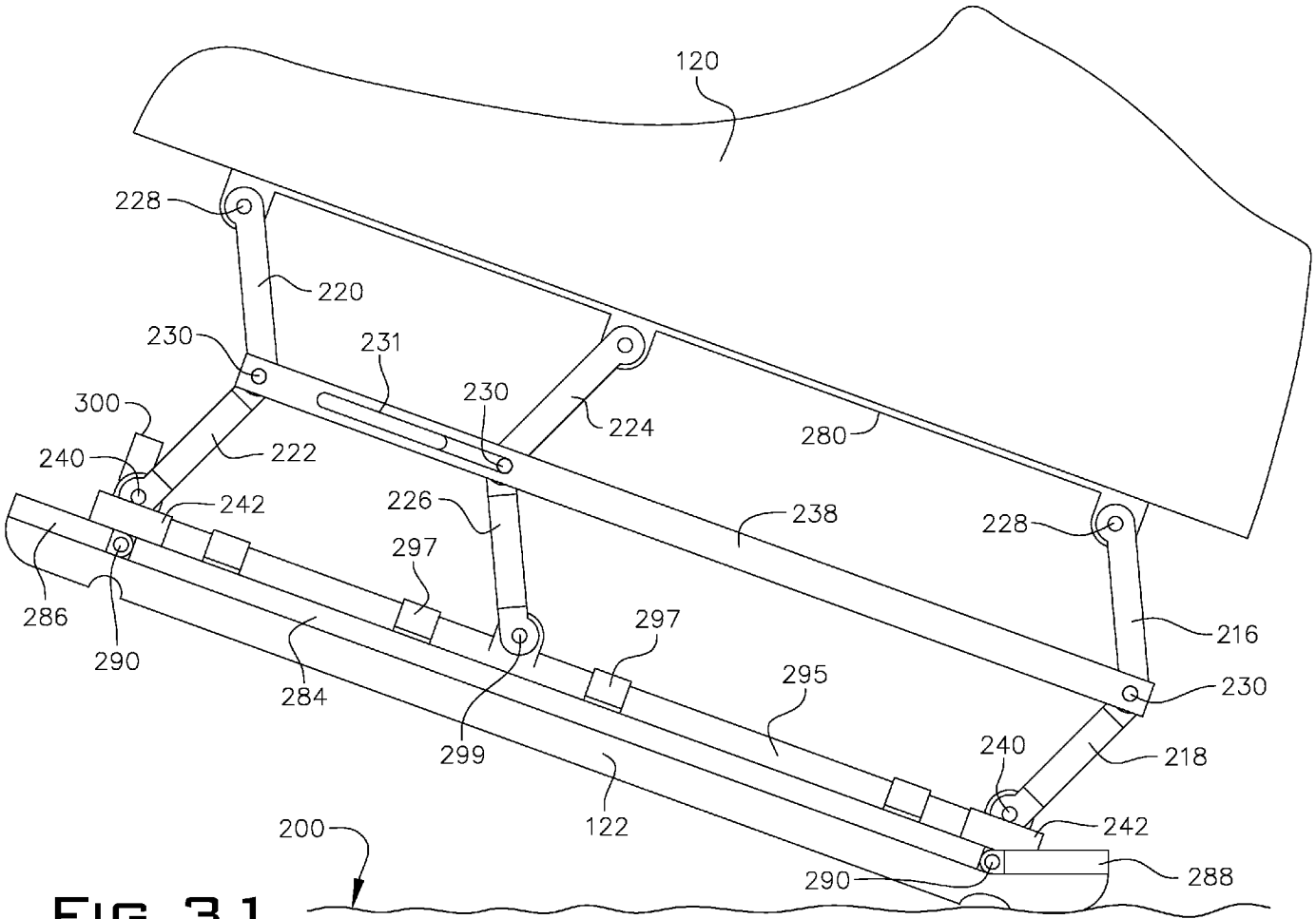
FIG. 31 illustrates a side schematic view using the suspension mechanisms of the third embodiment of the present invention integrated in a shoe before the heel contacts the surface.
Figure 32:
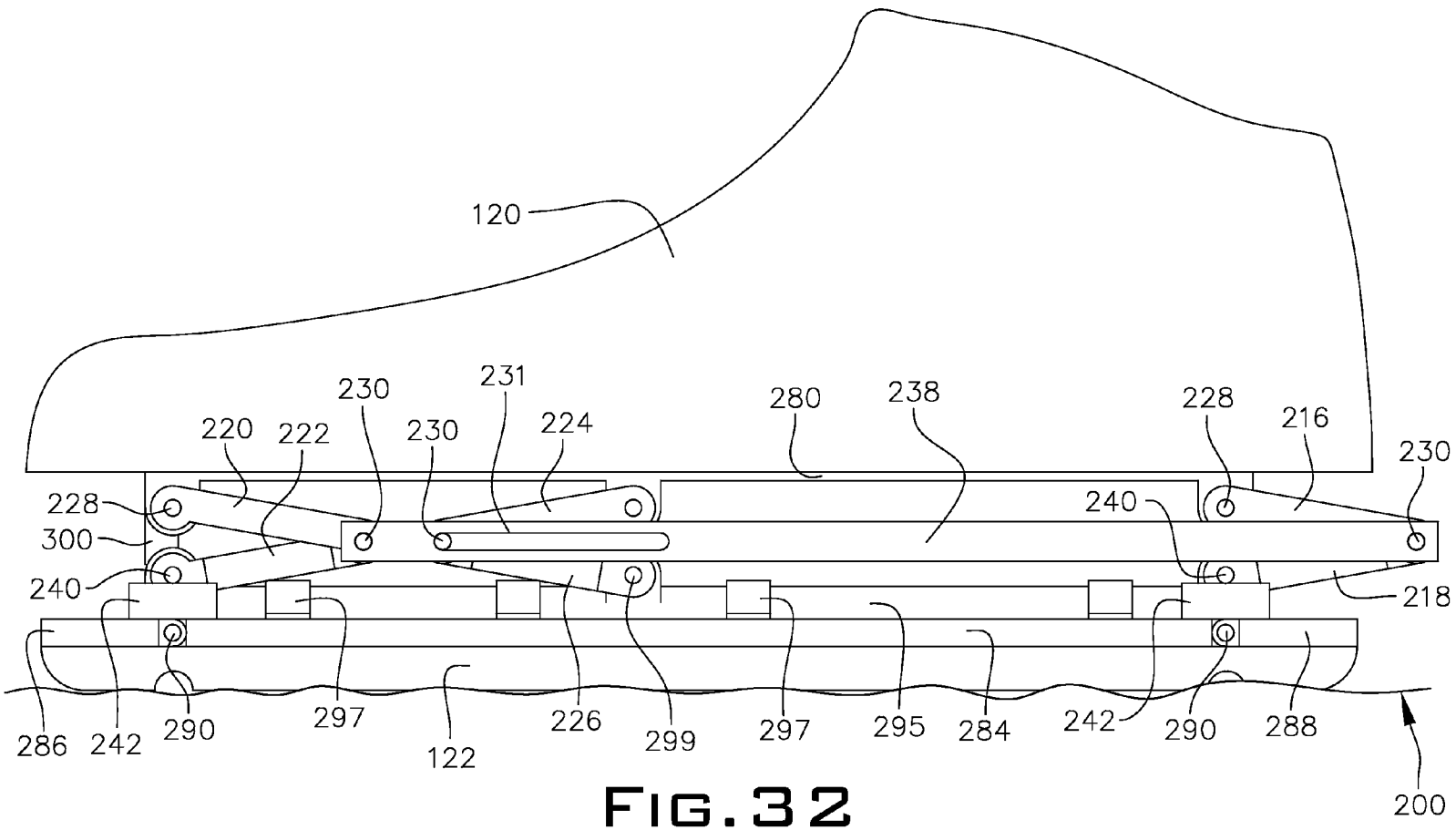
FIG. 32 illustrates a side schematic view a system using the suspension mechanisms of the third embodiment of the present invention integrated in a shoe after the heel contacts the surface.
Figure 33:
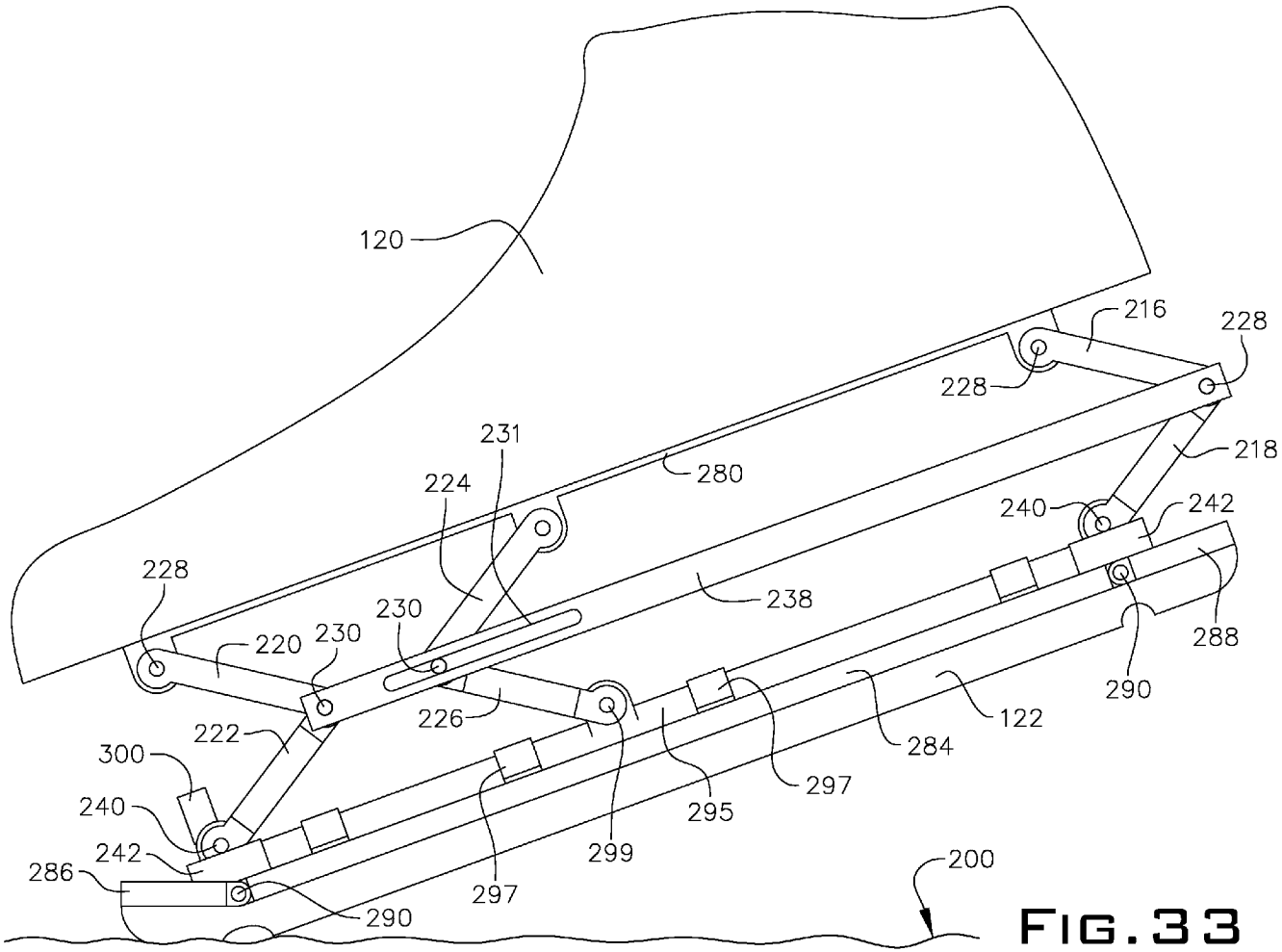
FIG. 33 illustrates a side schematic view of a system using the suspension mechanisms of the third embodiment of the present invention integrated in a shoe before the toe releases contact with the surface.

Referring to FIGS. 31-33, a side schematic view of the energy-return system 210 of the third embodiment of the present invention integrated with a shoe part 120 before the heel contacts the surface (FIG. 31), after the heel contacts the surface (FIG. 32) and before the toe releases contact with the surface (FIG. 33). In FIG. 31, the wearer of the shoe 120 has begun to step down, placing the heel on the surface 200. Note the heel plate 288 has bent along the pivot 290 to provide an enlarged contact point. Since no significant weight is applied by the user, compression of the suspension system 210 has not occurred. Referring to FIG. 32, the full weight of the user is applied and the suspension system 210 has collapsed to its fullest extent. In some embodiments, a motion limiter 300 restricts the amount of closure and provides resistance to closure before the pivot of the backward hinge 224/226 reaches the end of its travel through the slot 231 in the rigid connecting rod 238. Referring to FIG. 33, the user starts lifting their foot and the suspension system 210 begins to expand, applying the force stored in the suspension system's 210 springs 302/308 to boost the user's foot off of the surface 200.

Figure 34:
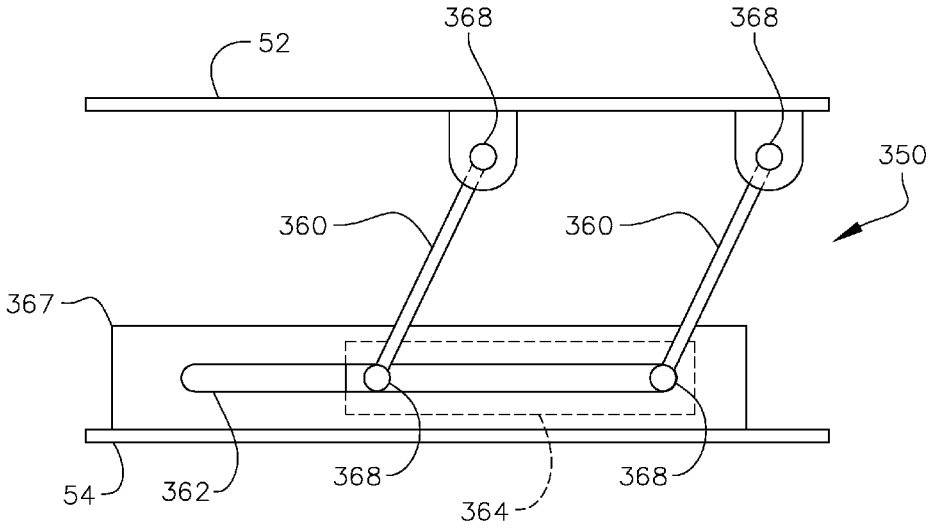
FIG. 34 illustrates a side view of an alternate embodiment of a toe suspension mechanism of the present invention.
Figure 35:
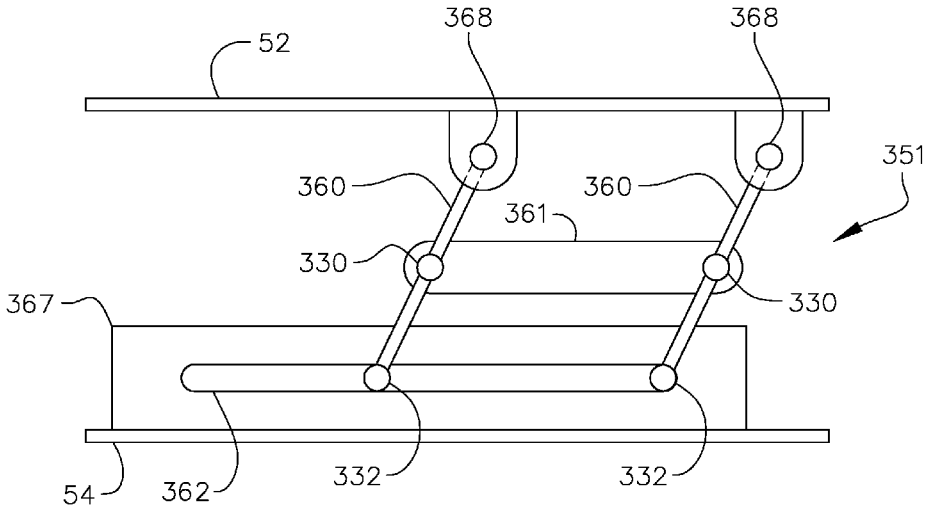
FIG. 35 illustrates a side view of another alternate embodiment of a toe suspension mechanism of the present invention.

Referring to FIGS. 34 and 35, a side view of alternate embodiments of toe suspension mechanisms is shown. The toe suspension mechanism of FIGS. 34 and 35 provide parallel synchronization to the toe area of the shoe so that when integrated into a shoe along with the heel suspension mechanism of FIGS. 1-5, the upper toe sole maintains parallel synchronization with respect to the lower toe sole as maintained by the movement of the heel suspension mechanism 10.

To achieve parallel synchronization, the toe suspension mechanism 350 includes a top toe plate 52 that is affixed to an upper toe sole (not shown) and a bottom toe plate 54 that is affixed to a lower toe sole (not shown). The top toe plate 52 and bottom toe plate 54 are supported by a toe hinge, although additional toe hinges are envisioned if needed. The toe hinge closes in the same direction, preferably towards the heel area.

The toe hinge consists of two toe arms 360 hingedly coupled to the top toe plate 52 by pivots 368. It should be noted that the pivots 368 can be any hinge/pivot known in the industry including screws/bolts, shafts/retainer-rings and rivets. The hinge arms 360 are preferably parallel to each other. In FIG. 34, the toe hinges are coupled to a slider 364 by pivots 368. The slider 364 slidably moves within a track or containment mechanism 367 and the pivots 368 couple to the toe arms 360 through a slot 362. The slot 362 controls the distance that the toe arms 360 are allowed to travel. In this example, the track or containment mechanism 367 is in the form of a coupling tube, though other forms of rigid toe couplings are anticipated.

The example of FIG. 35 is similar to that of FIG. 34 except there is no slider 364. Instead, the pivots 332 freely slide within a slot 362 of the track or containment mechanism 367. To maintain parallel synchronization between the toe arms 360, a spacing bar 361 is pivotally connected to each toe arm 360 by pivots 330. Although the spacing bar works at any point along the toe arms 360, it is preferred that it be positioned toward the sliding pivot 332. Also, although the spacing bar 361 is shown pivotally attached at approximately the same position on both toe arms 360, there may be an advantage in positioning it such that the attachment point on the forward toe arm 360 is closer or farther to the sliding pivot 332, relative to the attachment point on the rearward toe arm 360.

Equivalent elements can be substituted for the ones set forth above such that they perform in substantially the same manner in substantially the same way for achieving substantially the same result.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. An energy-return shoe system comprising:

a shoe portion;

an upper sole affixed to the shoe portion;

a lower sole;

an upper toe support plate affixed to a toe area of the upper sole;

an upper heel support plate affixed to a heel area of the upper sole, the upper heel support plate pivotally connected to the upper toe support plate;

a lower toe support plate affixed to a toe area of a top surface of the lower sole and interfaced to the upper toe support plate with at least one toe suspension mechanism;

a lower heel support plate affixed to a heel area of the top surface of the lower sole and interfaced to the upper heel support plate by at least one heel suspension mechanism, the lower heel support plate pivotally connected to the lower toe support plate;

wherein each of the at least one toe suspension mechanisms comprises:

a top toe plate affixed to the upper toe support plate;

a bottom toe plate affixed to the lower toe support plate;

one or more toe hinges arranged to close in a same direction, each of the toe hinges consisting of a first arm connected to a second arm by a toe hinge pivot, a distal end of the first arm pivotally connected at to the top toe plate, a distal end of the second arm pivotally connected to the bottom toe plate;

a rigid coupling pivotally connecting the toe hinge pivots whereas the top toe plate and the bottom toe plate are held in parallel synchronization;

wherein each of the at least one heel suspension mechanisms comprises:

a top heel plate affixed to the upper heel support plate;

a bottom heel plate affixed to the lower heel support plate;

a plurality of heel hinges, at least two of the heel hinges arranged to close in a first direction and at least one of the heel hinges arranged to close in an opposite direction, each of the heel hinges consisting of a first heel arm connected to a second heel arm by a heel pivot, a distal end of the first heel arm pivotally connected to the top heel plate and a distal end of the second heel arm pivotally connected to the bottom heel plate;

a first rigid coupling pivotally connecting the heel pivots of the at least two heel hinges arranged to close in the first direction;

a second rigid coupling slidably interfaced with the first rigid coupling and pivotally connects the heel pivots of the at least one heel hinge arranged to close in the opposite direction such that the heel pivots with the at least two heel hinges arranged to close in the first direction and the top heel plate are held in horizontal synchronization with respect to the bottom heel plate; and at least one spring pushing the upper heel support plate away from the lower heel support plate.

2. The energy-return shoe system of claim 1, wherein the lower sole is wider than the lower sole support plate.

3. The energy-return shoe system of claim 1, wherein the lower sole is longer than a length of the lower sole support plate plus a length of the lower heel support plate.

4. The energy-return shoe system of claim 1, wherein the at least one spring is at least one torsion spring.

5. The energy-return shoe system of claim 1, wherein the at least one spring is at least one leaf spring.

6. The energy-return shoe system of claim 1, wherein the at least one spring is at least one extension spring.

7. The energy-return shoe system of claim 1, wherein the at least one spring is at least one compression spring.

8. The energy-return shoe system of claim 1, wherein the at least one spring is at least two springs selected from the group consisting of a torsion spring, a leaf spring, an extension spring and a compression spring.

* * * * *